US006125243A

United States Patent [19]

Shoji et al.

[11] Patent Number: 6,125,243

[45] **Date of Patent: *Sep. 26, 2000**

[54] TONER REPLENISHING AND DEVELOPER REPLACING DEVICE FOR A DEVELOPING UNIT OF AN IMAGE FORMING APPARATUS

[75] Inventors: Hisashi Shoji, Kawasaki; Kiyotaka Ohta, Souka; Tsukuru Kai, Fujisawa; Nobuto Yokokawa, Yokohama; Kiyonori Tsuda; Satoshi Hatori, both of Tokyo, all of Japan

[73] Assignee: Ricoh Company, Ltd., Tokyo, Japan

[ * ] Notice: This patent is subject to a terminal disclaimer.

[21] Appl. No.: 09/157,613

[22] Filed: Sep. 21, 1998

Related U.S. Application Data

[63] Continuation of application No. 08/729,524, Oct. 11, 1996, Pat. No. 5,915,155.

[30] Foreign Application Priority Data

| | | | |
|---|---|---|---|
| Oct. 11, 1995 | [JP] | Japan | 7-262984 |
| Jan. 12, 1996 | [JP] | Japan | 8-4396 |
| Jan. 23, 1996 | [JP] | Japan | 8-9391 |
| Feb. 5, 1996 | [JP] | Japan | 8-18981 |
| Mar. 29, 1996 | [JP] | Japan | 8-77138 |

[51] Int. Cl.[7] ..... G03G 15/08

[52] U.S. Cl. ..... 399/29; 399/257

[58] Field of Search ..... 399/29, 30, 257, 399/43, 61, 62, 53

[56] References Cited

U.S. PATENT DOCUMENTS

| | | | |
|---|---|---|---|
| 4,226,525 | 10/1980 | Sakamoto et al. | 399/29 |
| 4,538,897 | 9/1985 | Osaka et al. | 399/29 |
| 4,614,165 | 9/1986 | Folkins et al. | 399/257 |
| 4,913,087 | 4/1990 | Saita et al. | 399/12 |
| 4,963,927 | 10/1990 | Ishihara | 399/29 |
| 5,162,849 | 11/1992 | Yoshino et al. | 399/29 |
| 5,235,391 | 8/1993 | Aimoto | 399/29 |
| 5,915,155 | 6/1999 | Shoji et al. | 399/262 |

*Primary Examiner*—Robert Beatty
*Attorney, Agent, or Firm*—Oblon, Spivak, McClelland, Maier & Neustadt, P.C.

[57] ABSTRACT

In an image forming apparatus, a developing unit for forming an image by use of a two-ingredient type developer, i.e., toner and carrier mixture, includes a container for replenishing fresh toner and for replacing carrier deteriorated due to aging or a developer including such carrier. The developer in the developing unit will be collected based on the number of times that a part of the developer has been replenished.

4 Claims, 31 Drawing Sheets

| Fig. 16A |
| --- |
| Fig. 16B |

TONER REPLENISHING AND DEVELOPER REPLACING DEVICE FOR A DEVELOPING UNIT OF AN IMAGE FORMING APPARATUS

This application is a Continuation of application Ser. No. 08/729,524, filed on Oct. 11, 1996, now U.S. Pat. No. 5,915,155.

BACKGROUND OF THE INVENTION

The present invention relates to a developing unit included in an image forming apparatus and for forming an image by use of a two-ingredient type developer, i.e., toner and carrier mixture. More particularly, the present invention is concerned with a device for replenishing fresh toner and replacing carrier deteriorated due to aging or a developer including such carrier.

A two-ingredient type developer is extensively used with an electrophotographic copier, facsimile apparatus, laser printer or similar image forming apparatus. This type of developer consists of carrier particles and toner particles depositing on the carrier particles due to frictional charge. Every time a developing unit included in the apparatus effects development, the toner particles are sequentially consumed. As a result, the ratio of the toner to the carrier and therefore the density of the resulting image decreases. It is therefore a common practice to replenish fresh toner to the developer in the same amount as the toner consumed. The carrier particles are each covered with a material for enhancing its frictional charging characteristic. The problem with the carrier particles is that the material covering them comes off due to repeated development, obstructing frictional charging between the carrier particles and the toner particles. The toner with no charge or short charge lowers image quality and flies about to contaminate the inside of the apparatus. Generally, the life of the developer expires when several thousands to several hundreds of thousands of sheets are dealt with.

In light of the above, it has been customary with an image forming apparatus to periodically dismount the developing unit from the apparatus body, evacuate a developing chamber of the deteriorated carrier or developer, and then fill the chamber with a new developer. The developer reached its life is entirely discharged from the developing chamber. The replacement of the developer, i.e., the removal of the developing unit needs an expert serviceman. There is an increasing demand for easy replacement when it comes to a high-speed copier or similar apparatus needing frequent replacement of the developer.

To meet the above demand, Japanese Patent Laid-Open Publication No. 60-107057, for example, proposes an automatic developer replacing system. In the proposed system, a shutter mounted on the bottom of a developing unit is opened in order to discharge the deteriorated developer. Then, a new developer is set in a hopper forming an upper portion of the developing unit. The new developer is automatically fed from the hopper into the developing unit. The system implements the replacement of the developer without the developing unit being dismounted from the apparatus. However, because the deteriorated developer is entirely replaced with a new developer at a time, image quality noticeably differs from the time just before the replacement to the time just after the replacement.

Further, the automatic replacing system requires an additional space for collecting the deteriorated developer, increasing the overall size of the apparatus. Moreover, a tank for the new developer and a container for the used developer are essential and need time- and labor-consuming management. Japanese patent Laid-Open Publication No. 4-118675, for example, teaches an arrangement including a developer replenishing chamber in which toner and carrier are stored independently of each other, and a developer collecting chamber for collecting the deteriorated developer from a developer storing section included in a developing unit. In this arrangement, after the deteriorated developer has been collected, the carrier and toner are sequentially replenished into the developer storing section in this order. While this kind of approach frees the operator from troublesome developer replacement, it also needs a space for the collection of the deteriorated toner. Again, because the developer existing in the developing unit is entirely replaced when its life expires, image quality noticeably differs from the time just before the replacement to the time just after the replacement.

To free image quality from the influence of the life of the developer, the developer may be replaced in a small amount at a time, as disclosed in, e.g., Japanese Patent Laid-Open Publication No. 4-29271. In such a system, when a dry two-ingredient type developer existing in a developing unit is consumed by a preselected amount, it is discharged only in a preselected small amount. In this case, a new developer is fed into the developing unit in substantially the same amount as the developer discharged.

Laid-Open Publication No. 4-118675 mentioned earlier teaches an arrangement including a developer replenishing chamber in which toner and a toner and carrier mixture are stored independently of each other, and a developer collecting chamber for collecting the deteriorated developer from a developer storing section included in a developing unit. When the toner concentration of the developer existing in the developer storing section decreases, as determined by a toner concentration sensor, the toner and the mixture are replenished into the storing section until the developer in the storing section reaches a preselected amount. Subsequently, the deteriorated developer is collected in the collecting chamber by an amount substantially equal to the total amount of the toner and mixture replenished. In this manner, the developer is replaced in a small amount at a time.

When the developer is replaced little by little before its life expires, as stated above, the developer in the developing unit is prevented from bodily reaching its life and maintains a stable degree of fatigue.

However, Laid-Open Publication No. 4-29271 pertains only to the replenishment and collection of a developer, so that toner must be replenished alone by some additional implementation. Specifically, the developer is automatically fed into the developing unit and collected therefrom. However, when the developer tank is replenished with a developer or replaced with a new developer tank, the operation is troublesome because the replenishing cycle of the developer is different from that of toner. Moreover, replenishment and collection or replacement is required with each of the developer tank, collecting container, and toner container, failing to free the serviceman or the operator from heavy burden. In addition, to reduce the time and labor for developer replacement, the developer tank and collecting container must be increased in size, rendering the entire apparatus bulky.

Assume that the developer is repeatedly replaced little by little, as taught in Laid-Open Publication Nos. 4-29271 and 4-118675. The prerequisite with this scheme is that to further stabilize image quality, not only the toner concentration of the developer depending on the toner consumption be controlled, but also the amount of the developer in the developing unit be confined in a certain range. Therefore, it is necessary to collect the carrier in a constant amount; otherwise, the amount of the developer would change due to repeated replacement. Laid-Open Publication No 4-29271 determines the consumption of the developer in terms of the number of printings produced or the duration of operation of the developing unit. This does not give any consideration to the consumption of the toner up to the time of replacement of the developer (which depends on the amount of image information), i.e., the toner concentration of the developer at the time of replacement.

Japanese Patent Laid-Open Publication 6-27809 pays attention to the fact that the deterioration of the developer is proportional to the duration of rotation of a rotary mechanism included in a developing unit. In accordance with this document, the duration of rotation of the rotary mechanism is counted and added up. Every time the cumulative duration reaches a preselected duration, fresh carrier or developer is replenished in a preselected amount such that a cumulative amount proportional to the cumulative duration is set up. Even this kind of approach determines the deterioration of the developer in terms of the duration of rotation, i.e., the duration of operation of the developing unit. On the other hand, for the collection of the developer, use is made of an overflow scheme. Because the overflow scheme does not take account of the toner concentration at the time of replacement of the developer, the amount of collection of the carrier is dependent on the toner concentration despite that the developer is replaced by a preselected amount. Although toner may be replenished alone later in order to adjust the toner concentration, the amount of the carrier in the developing unit is not corrected, causing the amount of the developer to change due to repeated replacement.

None of the prior art approaches described above gives consideration to problems particular to the initial installation of the apparatus at the user's station. Assume that the developing unit is loaded with the developer before the apparatus is transported to the user's station and operated for the first time there. Then, it is likely that the developer locally concentrates in the developing unit or drops via a gap between the developing unit and an image carrier. Therefore, at the time of forwarding, the developing unit, whether it be of the collective replacement type or of the little-by-little replacement type, must be held empty and then loaded with the developer from a container before the initial operation. Alternatively, the apparatus must include an exclusive section for storing a developer for the initial operation and automatically feed the developer to the developing unit before the initial operation. The former scheme needs the serviceman's or user's manual work while the latter makes the apparatus bulky and sophisticated due to the additional space for the developer. Even when the developer is replaced little by little, as taught in Laid-Open Publication No. 4-118675, the developer for the initial operation and to be fed from the exclusive chamber requires the chamber to have a considerable volume for the first loading of the developer, as in the collective replacement system. This also increases the overall size of the apparatus.

On the other hand, Japanese Patent Laid-Open Publication Nos. 60-159769 and 7-20705 each disclose a bottle for replenishing fresh toner into the developing unit. The bottle has a spiral ridge on its inner circumferential surface. When the bottle is rotated in its horizontal position, the spiral ridge drives the toner out of the bottle. However, the bottle is simply used to replenish the toner into the developing unit.

Further, Japanese Patent Laid-Open Publication No. 2-6978 proposes a toner container removable from the developing unit and consisting of a toner replenishing portion and a toner collecting portion. The container collects toner in the collecting portion separated from the replenishing portion. The collecting portion occupies an exclusive space in the container, and therefore increases the overall size of the apparatus. In addition, such a container is wasteful as to the space for stock.

In the above circumstances, the automatic collection of the deteriorated or used developer is essential which does not increase the size of the apparatus or trouble a serviceman or the user. As for the effective use of a limited space, it is preferable that the toner container storing fresh toner collects the used developer therein. However, the toner container includes means for promoting the efficient discharge of the toner, e.g., the spiral ridge taught in Laid-Open Publication No. 60-159769 or a scoop portion taught in Laid-Open Publication No. 7-20705. The scoop portion is implemented by a part of the inner surface of the shoulder portion of the container. Specifically, the inner surface with a greater diameter than a mouth portion bulges toward the edge of the mouth portion. However, such means for the effective discharge of the toner is undesirable when it comes to the collection of toner, because it prevents the expected amount of toner from being collected.

Japanese Patent Laid-Open Publication No. 7-171157, for example, teaches a bottle consisting of an annular first container and a hollow cylindrical second container received in the central through bore of the first container concentrically therewith. The two containers have concentric openings at the same side. A problem with this combined container scheme is that it must be rotated in opposite directions, increasing the cost of a drive source and the cost in the control aspect. Another problem is that the drive source needs an exclusive space and thereby increases the overall size of the apparatus.

SUMMARY OF THE INVENTION

It is therefore an object of the present invention to provide a developing device capable of supplying, in the event of the constant small amount of replacement of a two-ingredient type developer, a developer in relation to the replenishment of toner, thereby promoting user-oriented maintenance.

It is another object of the present invention to provide an image forming apparatus allowing a developer for the initial operation to be loaded without requiring any additional space or mechanism.

It is yet another object of the present invention to provide a developing device capable of maintaining, in the event of the small amount of replacement of a two-ingredient type developer, the amount of collection of carrier constant and thereby reducing a change in a developer in a developing unit as far as possible.

It is a further object of the present invention to provide a toner and developer replenishing device having a simple construction including a minimum number of parts, capable of insuring the replenishment of toner and developer and the collection of a deteriorated developer, and preventing an image forming apparatus from being increased in size.

It is an additional object of the present invention to provide a toner and developer supplying and developer collecting device having a replenishing portion and a collecting portion implemented by a single member, and capable of replenishing the toner and developer and collecting the developer while reducing the number of parts and space for drive.

In accordance with the present invention, a developing device includes a container operable in a horizontal position and including a first space storing two-ingredient type developer and a second space storing fresh toner. The first and second spaces are connected integrally with each other. A developing chamber is communicable to the container. A drive section causes the container to rotate about the axis of the container such that when the container rotates in one direction, the developer and the toner are replenished into the developer chamber.

Also, in accordance with the present invention, an image forming apparatus includes an image carrier for electrostatically forming a latent image thereon. A developing unit develops the latent image with a two-ingredient type developer to thereby form a corresponding toner image. A cartridge mounting section allows a cartridge storing a developer to be replenished into the developing unit to be mounted thereto. A controller controls drivelines relating to the replenishment of the developer from the cartridge into the developing unit. The controller controls the drivelines such that when a cartridge is initially mounted to tje mounting section, the developer is fed to the developing unit in a reference amount for image formation, and when a second cartridge is mounted next, the developer is fed to the developing unit to suffice an amount necessary for image formation to start.

Also, in accordance with the present invention, in a method of replenishing toner, as needed, on the basis of the toner concentration of a two-ingredient type developer existing in a developing chamber, and replacing a part of the developer at a preselected timing, the collection of the developer begins after the time when the toner concentration of the developer existing in the developing chamber does not recover a preselected concentration despite the replenishment of the toner.

Further, in accordance with the present invention, a device for replenishing toner and a developer into a developing section including in a developing unit includes a container storing the toner and the developer. A replenishing portion receives the toner or the developer driven out of the container, and rotatable to feed the toner or the developer to the developing section. A collecting portion is rotatable to raise a developer received from the developing section.

Furthermore, in accordance with the present invention, a device for replenishing toner and a developer into a developing section included in a developing unit, and collecting a developer from the developing section includes a bottle storing the toner and the developer. The bottle has an annular first container and a hollow cylindrical second container received in the central through bore of the first container concentrically therewith. The first and second containers include concentric openings formed at the same time. A replenishing device includes a replenishing portion for receiving the toner or the developer driven out of the container, and rotatable to feed the toner or the developer to the developing section, a collecting portion rotatable to raise a developer received from the developing section, a rotary member including a center opening and a space which is defined by a circumferential wall and an inner wall of the rotary member and has a bottom sequentially rising toward the downstream side with respect to the direction of rotation of the replenishing portion, and an intermediate member including a flat portion slidably contacting the upper edge of the rotary member and that of the inner wall for thereby defining a space for replenishment, and a port for discharging the toner or the developer raised due to rotation of the rotary member.

Moreover, in accordance with the present invention, in a bottle for storing toner and a developer and including an annular first container and a hollow cylindrical second container received in a central through bore of the first container concentrically with the first container, the first and second containers having concentric openings at the same side, the bottle includes mating portions for drive transmission.

In addition, in accordance with the present invention, a device for replenishing toner and a developer to a developing section included in a developing unit includes a replenishing portion for receiving the toner or the and rotatable to feed the toner or the developer to the developing section. A collecting portion is rotatable to raise a developer received from the developing section. A rotary member includes a center opening and a space which is defined by a circumferential wall and an inner wall of the rotary member and has a bottom sequentially rising toward the downstream side with respect to the direction of rotation of the replenishing portion. An intermediate member includes a flat portion slidably contacting the upper edge of the rotary member and that of the inner wall for thereby defining a space for replenishment, and a port for discharging the toner or the developer raised due to rotation of the rotary member.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Preferred embodiments of the present invention will be described hereinafter.

1st Embodiment

Figure 1:
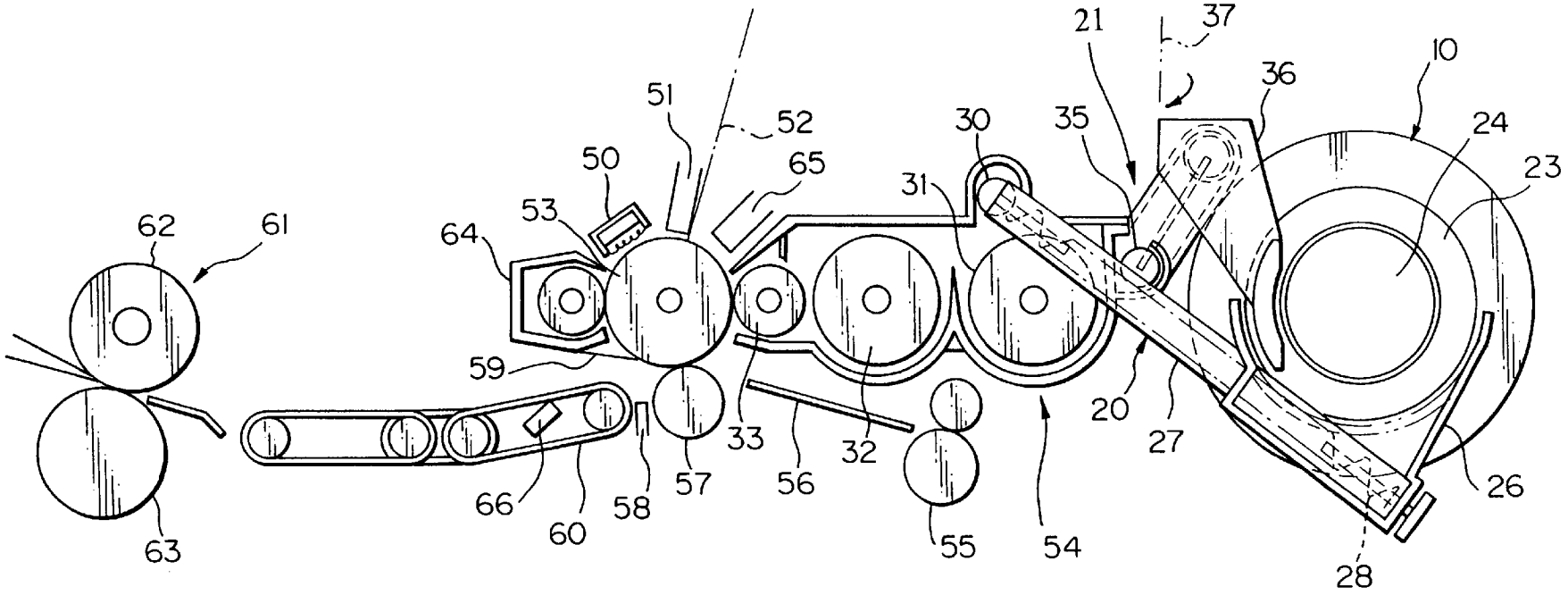
FIG. 1 is a section showing an image forming engine including a first embodiment of the developing device in accordance with the present invention.

Referring to FIG. 1 of the drawings, there is shown an image forming engine including a developing device embodying the present invention. As shown, the engine includes a main charger 50 for uniformly charging the surface of a photoconductive element 53 implemented as a drum. A latent image is electrostatically formed on the charged surface of the drum 53 either by slit exposure (analog) 51 or by laser exposure (digital) 52. A developing device 54 develops the latent image with toner to thereby form a corresponding toner image. A registration roller 55 drives a sheet, not shown, toward the drum 53 along a guide 56 at a preselected timing. An image transfer unit 57 transfers the toner image from the drum 53 to the sheet. A discharge brush 58 discharges the sheet in order to stabilize the conveyance of the sheet. The sheet is separated from the drum 53 by a separator 59 and then conveyed to a fixing unit 61 by a conveyor belt 60. The fixing unit 61 fixes the toner image on the sheet with a heat roller 62 and a press roller 63.

A cleaning unit removes the toner remaining on the drum 53 after the image transfer so as to prepare the drum 53 for the next image formation. An eraser 65 is interposed between the exposing section and the developing device 54. The eraser 65 dissipates the charge on the drum 53 in order to prevent the toner from depositing on the needless portions of the drum 53. A sheet sensor 66 adjoins the conveyor belt 60 and senses the separation of the sheet from the drum 53 for the purposes of avoiding a jam and the wrapping of the sheet around the drum 53.

Figure 2A:
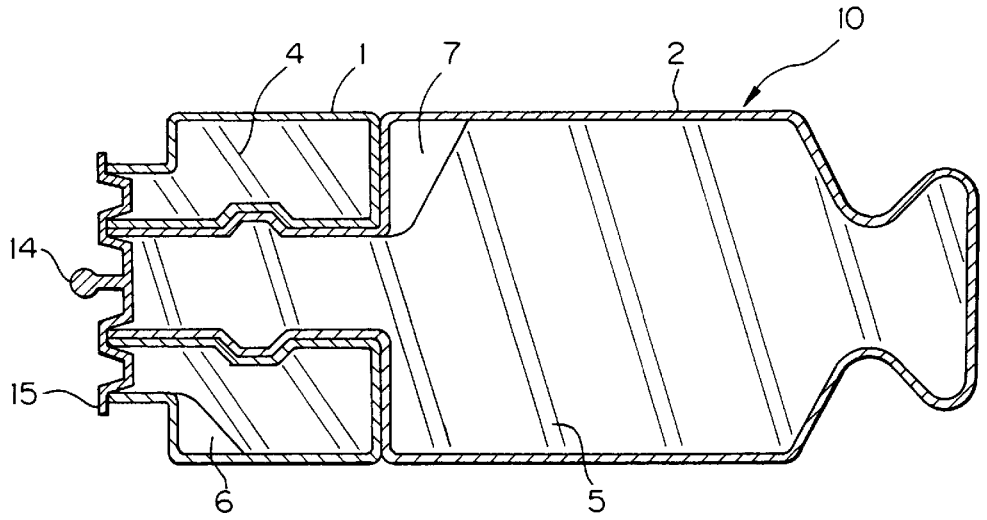
FIGS. 2A and 2B are sections showing a container included in the embodiment.
Figure 2B:
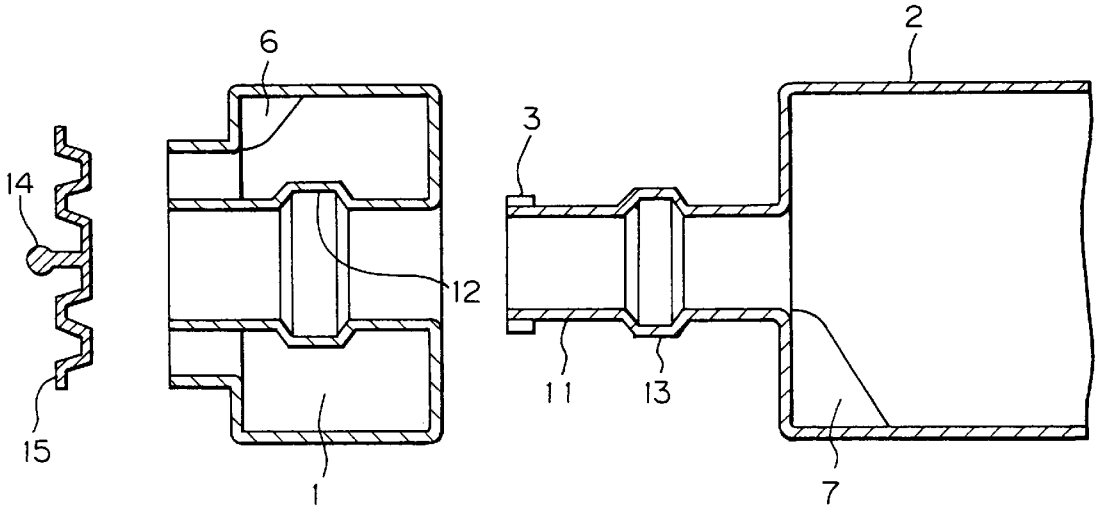

A single container 10 is communicated to the developing device 54 by a replenishing device 20 and a discharging device 21. As shown in FIG. 2A in detail, the container 10 consists of an annular first container 1 having a hollow cylindrical second container 2 mating with the first container 1 concentrically. As shown in FIG. 2B, the second container 2 has a projection 11 received in a through bore formed at the center of the annular first container 1. An annular ridge 13 is formed on the circumference of the projection 11 and received in an annular recess 12 formed in the inner periphery of the container 1. An annular seal member 3 is adhered to the open end of the projection 11, as illustrated. With such a configuration, the two containers 1 and 2 are hermetically engaged with each other.

The first container 1 stores a fresh developer consisting of toner and carrier while the second container 2 stores fresh toner. The containers 1 and 2 put together as shown in FIG. 2A is rotatable integrally. Spiral ridges 4 and 5 are formed on the inner circumferential surfaces of the containers 1 and 2, respectively. When the containers 1 and 2 are rotated integrally in the same direction, the ridges 4 and 5 respectively convey the developer and toner toward the outside side of the assembly, i.e., to the left as view in FIG. 2A. To insure the discharge of the above contents, the containers 1 and 2 are respectively formed with scoop walls 6 and 7 each matching in configuration the spiral flow of the content. The scoop walls 6 and 7 are each positioned at the shoulder portion of the container 1 or 2 where a larger diameter portion merges into a smaller diameter portion. A common stopper 15 with a nip portion 14 is attached to the outlets of the containers 1 and 2. When the container 10 is mounted to the developing device 54, the stopper 15 is removed by, e.g., an automatic chuck.

Figure 3:
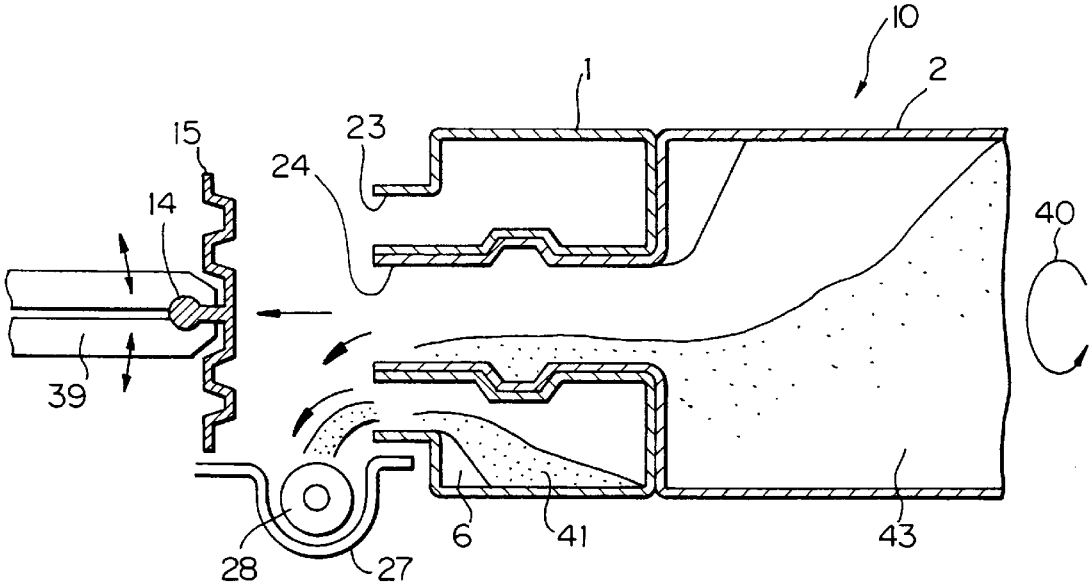
FIG. 3 shows the outlet portion of the container in a condition for replenishing a developer and toner.

A reference will be made to FIGS. 1 and 3 for describing the replenishment of the toner and developer. Initially, the container 1 stores a preselected weight of fresh developer wile the container 2 stores fresh toner. The words "preselected weight" refer to a single partial replacement of the developer; the weight is determined by, e.g., the volume of the developer to be used in the developing unit 54, the ratio between the volume of the developer and the amount of the toner stored in the container 10, and the rate of deterioration of the developer itself. Usually, about 10% of the amount of the developer used in the developing unit 54 suffices. The fresh developer is identical with a developer customarily used by, e.g., a serviceman at the time of replacement.

When the container 10 is replaced for the supply of a new developer, the developer in the developing unit 54 has already been collected in the container for collection in the same amount as the fresh toner to be replenished from the container 1, as will be described specifically later. When the new container 10 is set on the apparatus body, a toner end signal is appearing, i.e., the toner concentration of the developer in the developing device 54 is lower than an ideal toner concentration. Therefore, as soon as the new container 10 is set, a toner replenish signal is sent to the container 10. In response, the container 10 is rotated by a drive source, not shown, in a direction indicated by an arrow 40 in FIG. 3. The spiral ridge 5 of the container 2, FIG. 2A, replenishes the fresh toner, labeled 43, via an outlet 24. At the same time, the spiral ridge 4 of the container 1, FIG. 2A, replenishes the fresh developer via an outlet 23.

Both the developer and the toner driven out of the containers 1 and 2, respectively, are guided into a piping 27 by a guide 26. A screw 28 is disposed in the piping 27 and conveys the developer and toner into the developing device 54 via an inlet 30 formed in the top of the device 54.

A first screw 31 is positioned beneath the inlet 30 of the developing device 54 and forms a pair with a second screw 32. The first screw 31 conveys the fresh developer and toner introduced into the developing unit 54 from the rear to the front, as seen in the direction perpendicular to the sheet surface of FIG. 1, while agitating them. The second screw 32 conveys them from the front to the rear, as seen in the above direction, while agitating them. As a result, the fresh developer and fresh toner are uniformly mixed with the developer existing in the developing unit 54. The uniform mixture is driven toward a developing sleeve 33 so as to form a toner image on the drum 53.

Figure 4:
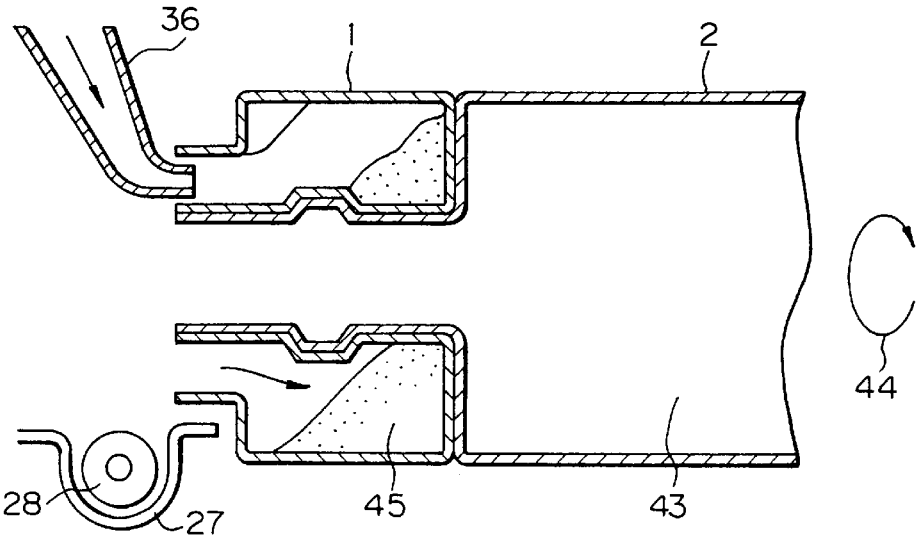
FIG. 4 shows the outlet portion of the container in a condition for collecting a used developer.

How the used or deteriorated toner is collected will be described with reference to FIGS. 1 and 4. The discharging device 21 is positioned at the rear of the replenishing device 20, as seen in the direction perpendicular to the sheet surface of FIG. 1. The fresh developer introduced into the developing device 54 causes the level of the developer to rise. On the rotation of the screws 31 and 32, the developer level waves. The used developer caused to overflow the developing unit 54 via an outlet 35 is conveyed by the discharging device 21 to the container 10 via a hopper-like guide 36. The discharging device 21 has a piping and a screw disposed in the piping. To facilitate the entry of the used developer in the container 10, the discharging device 21 once conveys the developer upward and then allows it to slide downward along the guide 36 due to its own weight. While the container 10 is in rotation in a direction indicated by an arrow 44 in FIG. 4, the developer, labeled 45, is introduced into the first container 1 and conveyed toward the bottom wall of the container 1 by the spiral ridge 4. The guide 36 is rotatable about a vertical axis 37, so that it can retract from the movable range of the stopper 15 when the stopper 15 is attached and detached. While the embodiment collects the used developer overflown the developing device 54 in the container 10, an exclusive waste developer container may be located in any suitable space available in the apparatus body so as to collect the waste toner coming out of the discharging device 21.

The timing for replenishing the fresh developer and toner and that for collecting the used developer will be described specifically. The fresh developer is replenished into the developing unit 54 at the same time as the fresh toner is replenished from the container 10, as stated earlier. To supply the toner, the container 10 is rotated in the direction 40, FIG. 3, every time a toner end condition is detected in the apparatus body. After the toner of the second container 2 has been fully consumed (toner end), the used developer is collected in the first container 1. To detect the toner end condition of the container 2, use may be made of an exclusive toner and sensor. Alternatively, the toner end condition of the container 2 may be determined in terms of a preselected number of times of toner end condition occurred in the apparatus body. After the container 2 has reached its toner end condition, the discharging device 21 is caused to operate when a toner end condition is again detected in the apparatus body. At the same time, the container 10 is rotated in the direction 44, FIG. 4, so as to collect the used toner therein.

Basically, the illustrative embodiment uses an overflow system for the collection of the deteriorated developer. The overflow system allows the deteriorated toner to be collected in the same amount as the fresh developer replenished into the developing unit 54. However, in the embodiment, a space for temporarily storing the overflown developer is absent; while the discharging device 21 is not operated, the above developer is continuously used as the developer in the developing unit 54. Just after the collection of the used developer, the amount of the developer existing in the developing device 54 is smaller than the amount to exist therein during the usual operation of the apparatus. Therefore, the fresh developer replenished from the container 10 is continuously used until the container 10 reaches its toner end condition. This prevents the fresh toner from being collected before it is fully used. That is, the fresh toner is uniformly mixed with the developer existing in the developing unit 54, fully used, and then collected in a preselected ratio.

Figure 5:
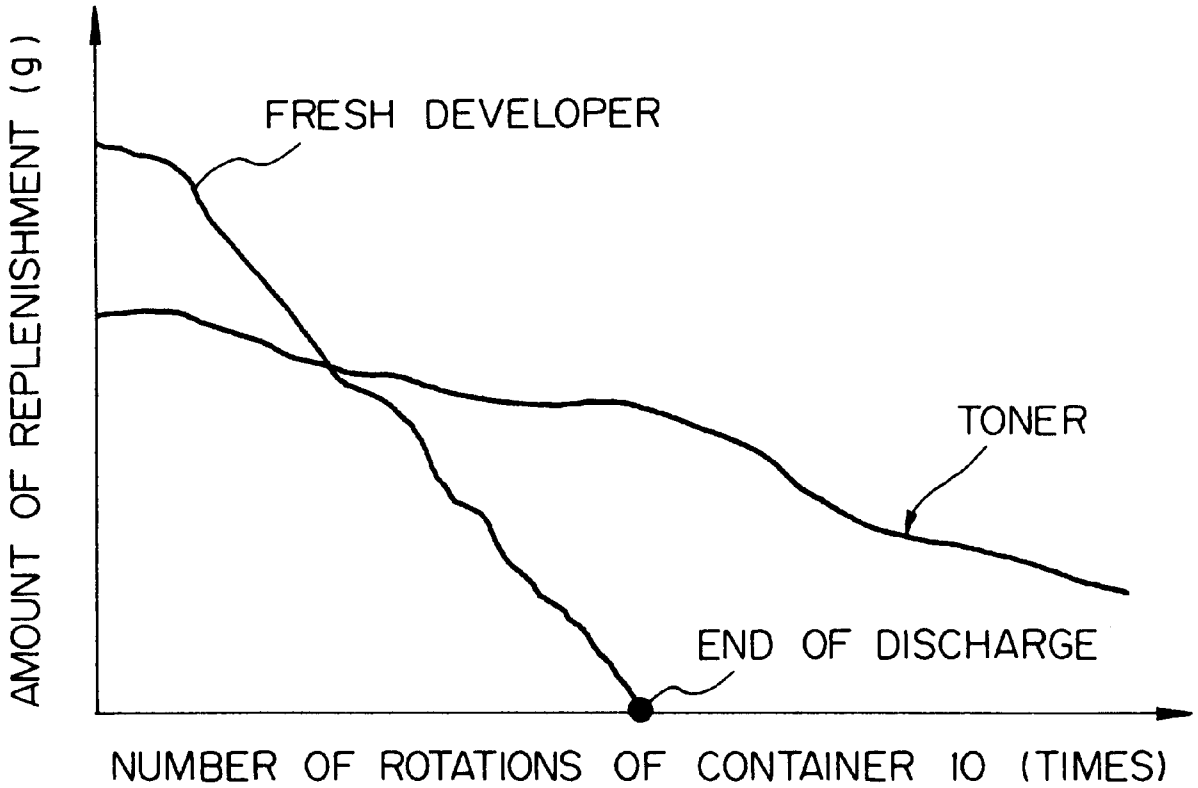
FIG. 5 is a graph showing a relation between the rotation of the container and the amount of developer discharge and holding when the developer is discharged at a higher rate than the toner.

The fresh toner is replenished a number of times for a single replenishment of the small amount of developer and is replenished even after the replenishment of the developer, as stated above. On the other hand, assume that the ratio of the fresh toner stored in the container 10 to the fresh developer is small, so that the toner and developer end substantially at the same time. Then, the prerequisite is that the developer in the container 1 be fully consumed before the container 10 reaches its toner end condition. To meet this requirement, use is made of a developer having higher fluidity than the toner. In this condition, so long as the scoop walls 6 and 7, FIG. 2, have the same inclination, the fresh toner is fully consumed before the fresh developer for the same amount of rotation of the container 10, as shown in FIG. 5. To promote the discharge of the fresh developer, the container 1 may be provided with an inclined bottom, or the spiral ridge 4 may have its pitch or inclination increased. The replenishing rate of the fresh developer should preferably be higher than that of the fresh toner as far as possible in order to stabilize the volume of the developer in the developing unit 54 rapidly.

As stated above, when a developer is replaced in a preselected small amount, the embodiment allows the developer to be automatically replenished in unison with the replenishment of fresh toner. This promotes user-oriented maintenance and simplifies the construction. An occurrence that the fresh developer is left in the container when the container reaches its toner end condition is obviated. The container is therefore prevented from being replaced before the developer is fully consumed.

2nd Embodiment

Figure 6:
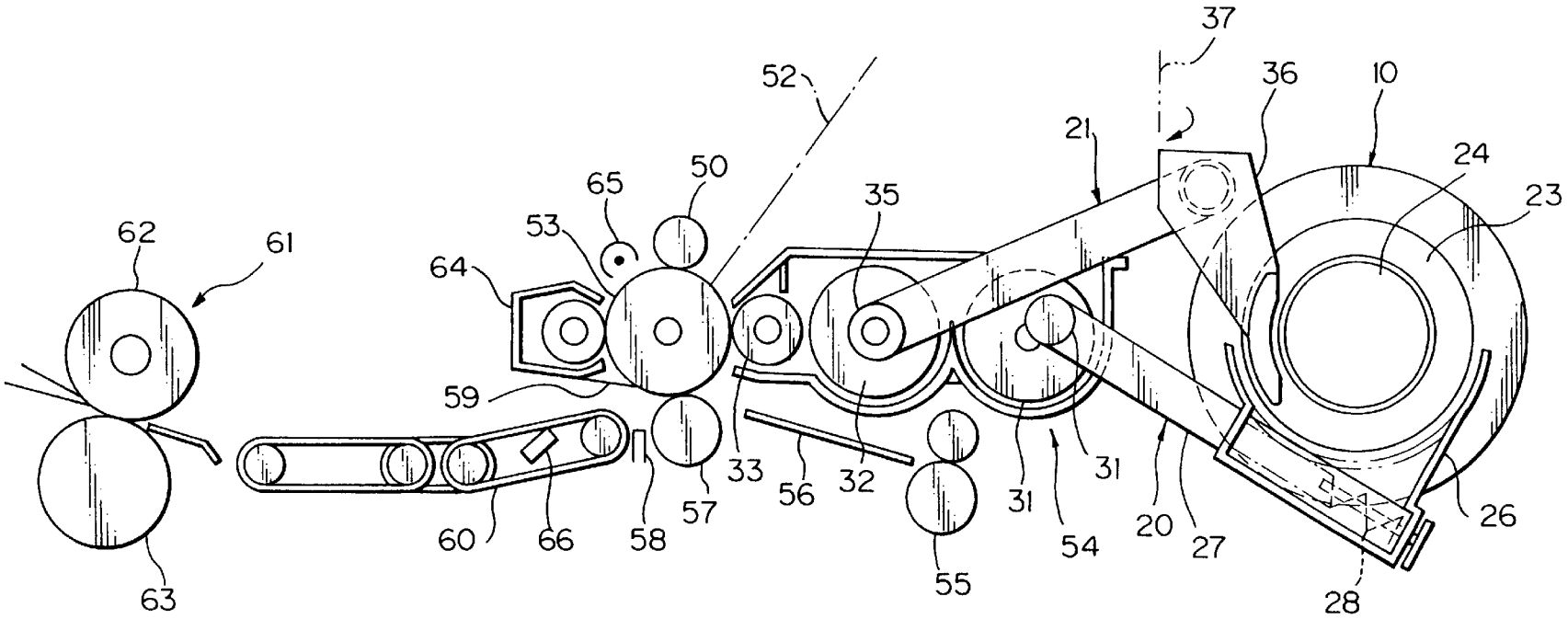
FIG. 6 is a section of an image forming engine including a second embodiment of the present invention.
Figure 7A:
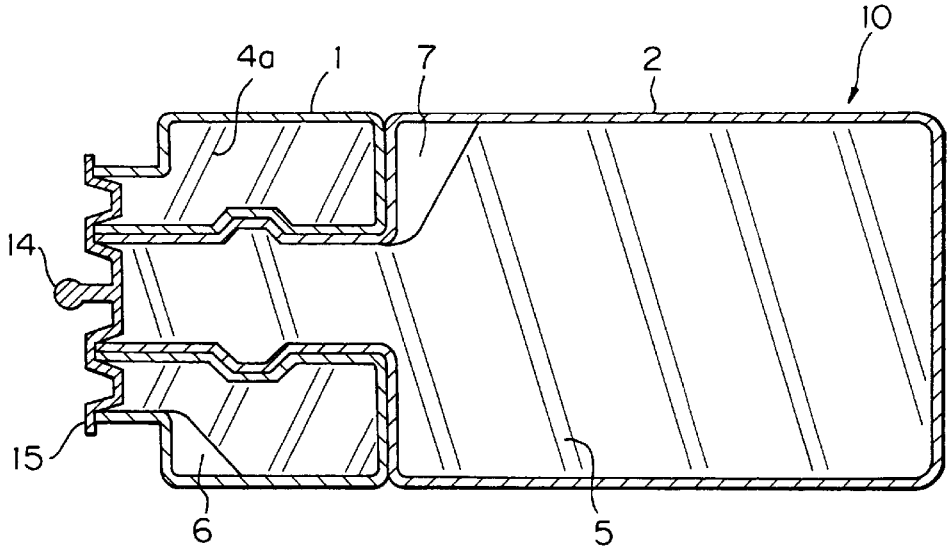
FIGS. 7A and 7B are sections of a container included in the second embodiment.
Figure 7B:
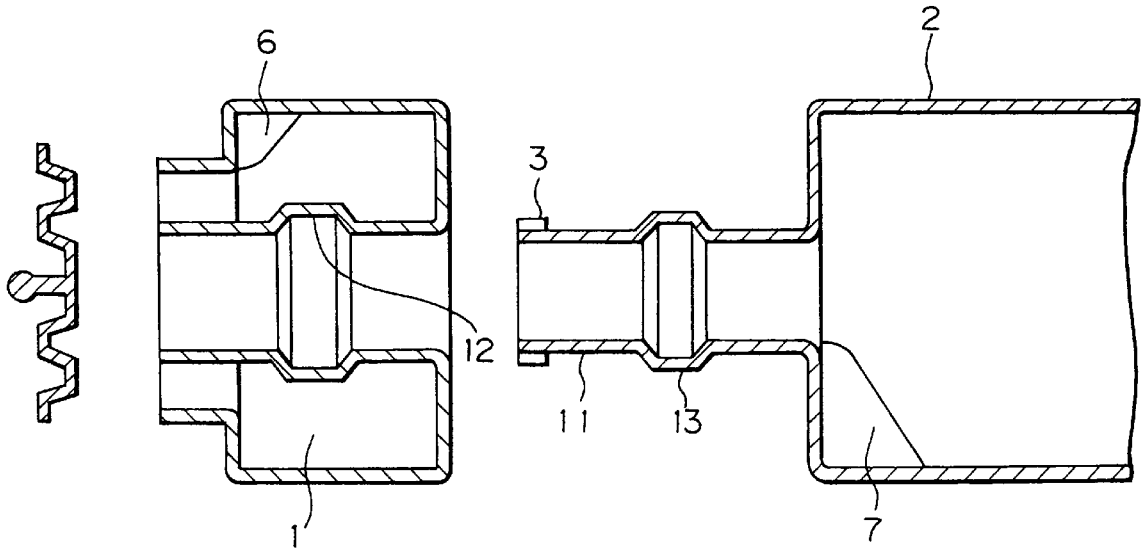

FIG. 6 shows an image forming embodiment to which a second embodiment of the present invention is applied. In FIG. 6, the same or similar structural elements as the elements shown in FIG. 1 are designated by the same reference numerals, and a detailed description thereof will not be made in order to avoid redundancy. As shown, the container or toner cartridge 10 is also communicated to the developing unit 54 by the replenishing device 20 and discharging device 21. The first and second containers 1 and 2 constituting the cartridge 10 respectively store the fresh developer and fresh toner, as in the first embodiment. As shown in FIG. 7A, a spiral ridge 4*a* and the spiral ridge 5 are respectively formed on the inner circumferential surfaces of the containers 1 and 2. In this embodiment, the ridges 4*a* and 5 are inclined in opposite directions to each other. Therefore, the ridges 4*a* and 5 respectively convey the developer and toner to the left, as viewed in FIG. 7A, when the cartridge 10 is rotated in opposite directions. Specifically, when the cartridge 10 is rotated in one direction, the ridge 4*a*, for example, conveys the developer toward the outlet side while the ridge 5 conveys the toner away from the outside side. This relation is reversed when the cartridge 10 is rotated in the other direction.

The container 1 initially stores the previously stated preselected weight of fresh developer while the container 2 stores fresh toner. Both the developer and the toner driven out of the cartridge 10 via a first and a second outlet 23 and 24, respectively, are guided into the piping 27 by the guide 26. The screw 28 disposed in the piping 27 conveys the developer and toner into the developing unit 54 via the inlet 30 formed in the top of the unit 54. The first screw 31 positioned beneath the inlet 30 of the unit 54 conveys the fresh developer and toner introduced into the unit 54 from the front to the rear, as seen in the direction perpendicular to the sheet surface of FIG. 6, while agitating them. The second screw 32 conveys them from the rear to the front, as seen in the above direction, while agitating them. As a result, the fresh developer and fresh toner are uniformly mixed with the developer existing in the unit 54. The uniform mixture is driven toward the developing sleeve 33 so as to form a toner image on the drum 53.

The discharging device 21 is attached to the outlet 35 formed in the developing unit 54 and adjoining the end of the second screw 32. The discharging device 21 discharges a part of the developer from the developing unit 54 and has a piping and a screw disposed in the piping. The developer flown out via the outlet 35 is conveyed by the discharging device 21 to the cartridge 10 along the guide 36. To facilitate the entry of the used developer in the cartridge 10, the discharging device 21 once conveys the developer upward and then allows it to slide downward along the guide 36 due to its own weight. While the container 10 is in rotation in a direction indicated by an arrow 44 in FIG. 4, the developer, labeled 45, is introduced into the first container 1 and conveyed toward the bottom of the container 1 by the spiral ridge 4*a*. The guide 36 is rotatable about the vertical axis 37, so that it can retract from the movable range of the stopper 15 when the stopper 15 is attached and detached.

When the cartridge 10 is mounted to the apparatus body, the developer stored in the first container 1 is replenished into the developing unit 54. Subsequently, the toner stored in the second container 2 is replenished in accordance with the consumption of toner in the developing unit 54. When the second container 2 become substantially empty, the developer is collected from the developing unit 54 into the first container 1.

Figure 8:
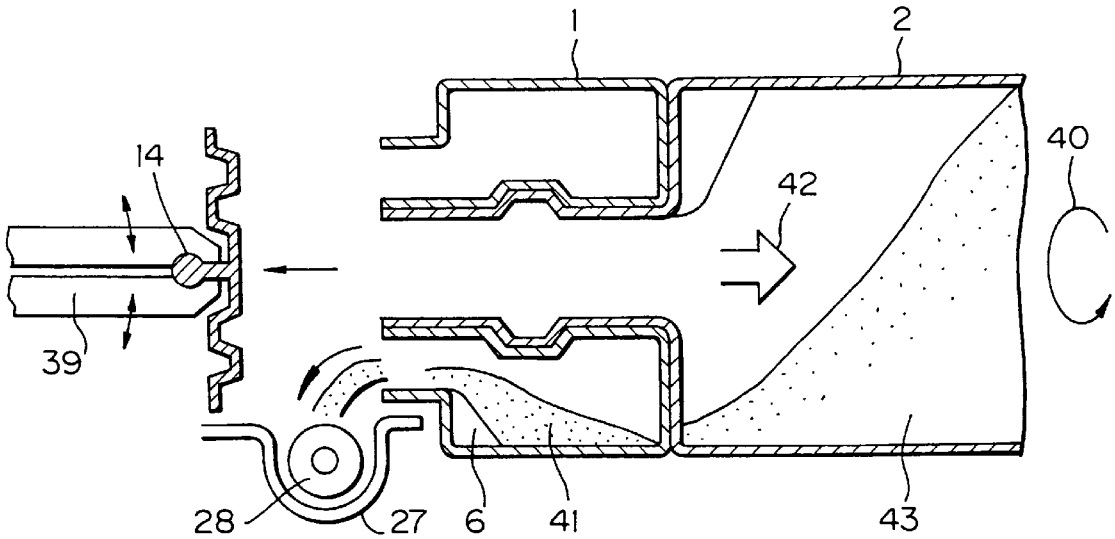
FIG. 8 shows how a developer is supplied from the container shown in FIG. 6.

As shown in FIG. 8, to replenish the developer form the first container 1, an automatic chuck 39 grips the nip portion 14 of the stopper 15, and then removes it in a direction indicated by an arrow. Subsequently, the cartridge 10 is rotated in the direction 40. As a result, the developer 41 is driven out of the first container 1 over the scoop wall 6 and then conveyed by the screw 28 to the developing unit 54. At this instant, the spiral ridge 5 of the second container 2 conveys the toner 43 in a direction indicated by an outline arrow 42 while agitating it. This successfully obviates toner blocking.

Figure 9:
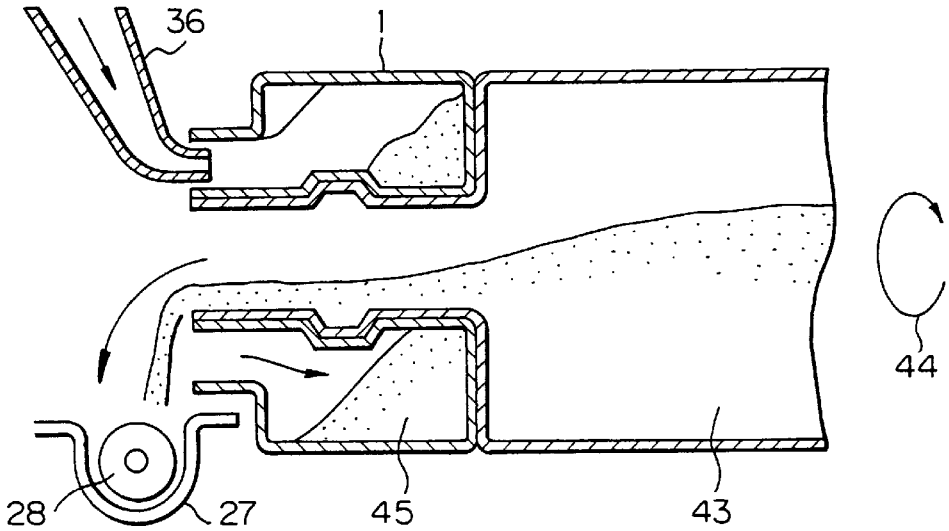
FIG. 9 shows how toner is supplied from the container of FIG. 6 and how a used developer is collected in the container.

As shown in FIG. 9, after the discharge of the developer or at the time of replenishment of the toner or the collection of the developer, the guide 36 is brought into communication with the outlet of the first container 1. When the cartridge 10 is rotated in the direction 44, the toner is discharged from the second container 2 and conveyed to the developing unit 54 by the screw 28. On the other hand, the used developer 45 overflowing the developing device 54 is collected in the first container 1 via the guide 36.

By the above procedure, the developer is automatically replaced with its toner concentration confined in a preselected range. The used developer is collected in the cartridge 10.

Figure 10:
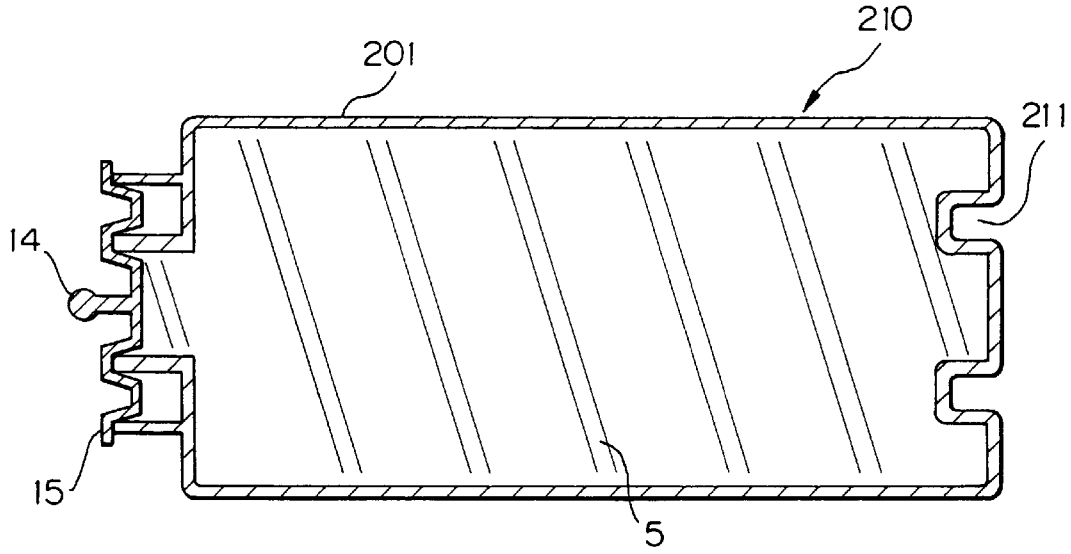
FIG. 10 is a section showing a developer container storing only a developer.

A developer for the initial operation is loaded in the developing unit 54, as follows. This is also done by using the same developer and toner conveying means and transport paths as during usual operation. FIG. 10 shows a developer cartridge 210. While the developer cartridge 210 resembles the cartridge 10 in appearance, it is formed with a recess 211 in its bottom so as to be distinguished from the cartridge 10. Further, the cartridge 210 is implemented as a single container. The spiral ridge 5 is also formed on the inner circumferential surface of the cartridge 210 in order to convey the developer toward an outlet while the cartridge 210 is in rotation. The stopper 15 with the nip portion 14 is also attached to the outlet of the cartridge 210 and removed therefrom when the cartridge 210 is mounted to the apparatus body.

Figure 11:
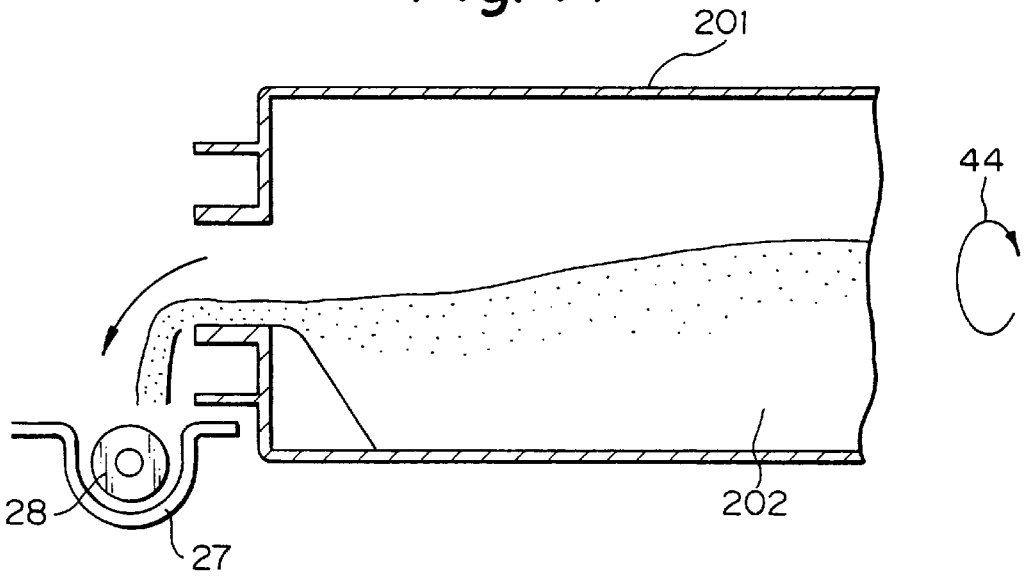
FIG. 11 shows how the developer is supplied from the developer container of FIG. 10.

As shown in FIG. 11, to discharge the developer from the cartridge 210, the cartridge 210 is rotated in the direction 44. As a result, the developer, labeled 202, is driven out of the cartridge 201 and conveyed by the screw 28 to the developing unit 54 via the same path as during the replenishment from the cartridge 10. This eliminates the need for an exclusive mechanism for the initial supply of the developer.

Figure 12:
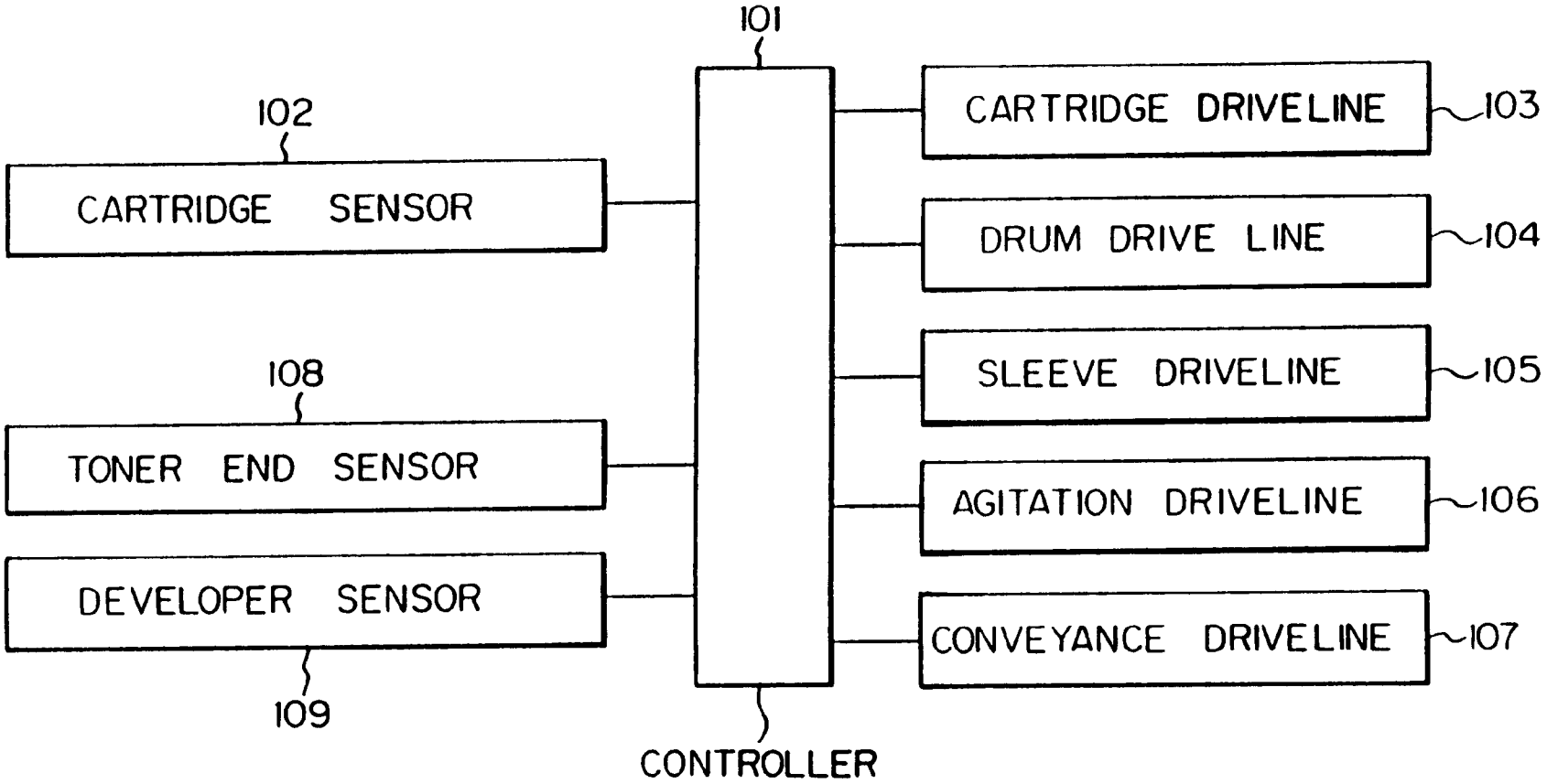
FIG. 12 is a block diagram schematically showing a control system included in the second embodiment.

FIG. 12 shows a control system for executing the above procedures. As shown, a controller 101 receives the output of a cartridge sensor 102 responsive to the kind of the cartridge. In response, the controller 101 controls the operations of a cartridge driveline 103, a drum driveline 104, a sleeve driveline 105, an agitation drive line 106 for driving the agitating means (including screws) of the developing unit 54, and a conveyance driveline 107 for driving the screws of the piping 27 and discharging device 21. Further, the controller 101 receives the output of a toner and sensor 108 responsive to the amount of toner remaining in the cartridge 10 and executes a developer collection mode when the cartridge 10 runs out of toner. The reference numeral 109 designates a developer sensor.

Figure 13A:
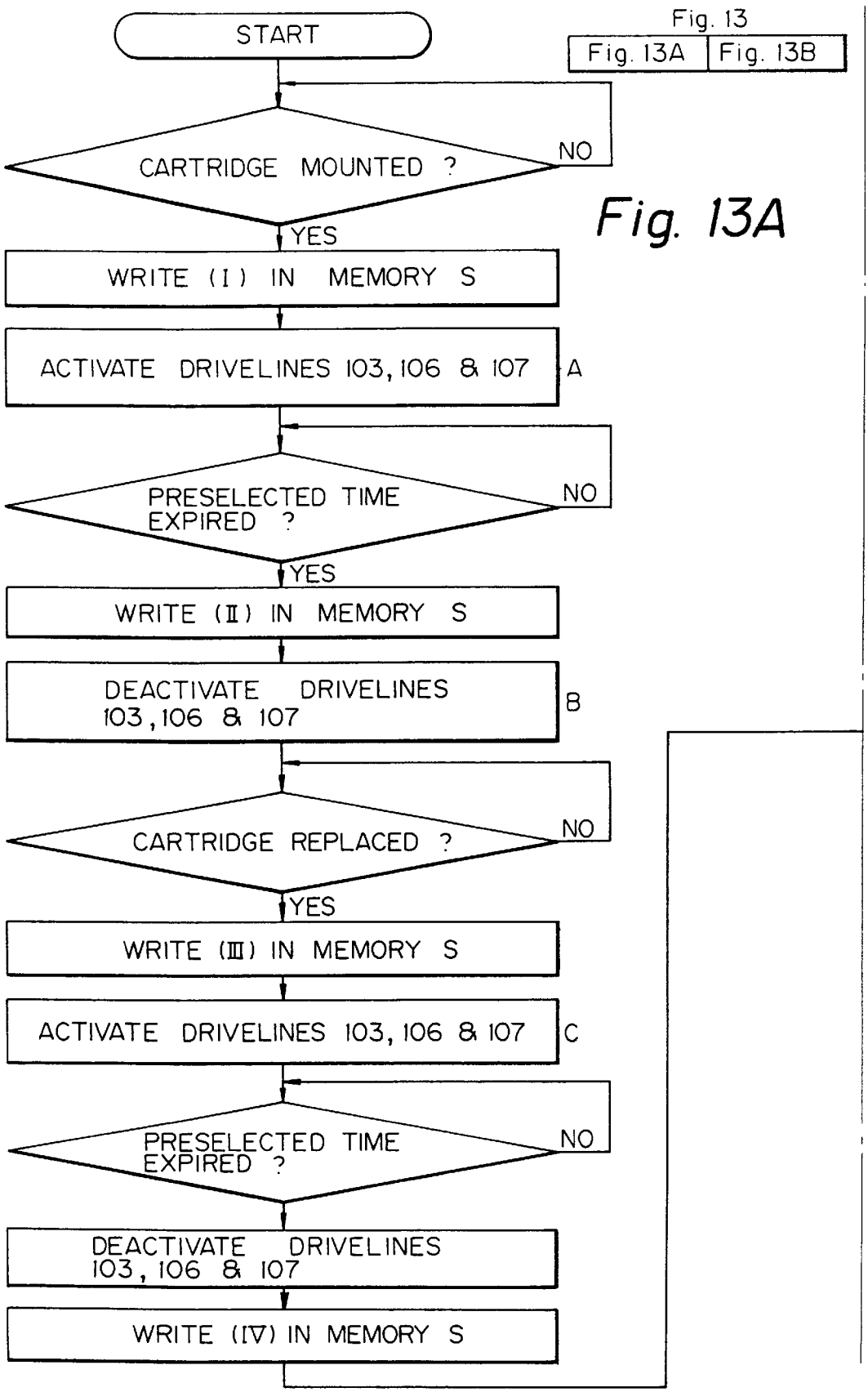
FIG. 13 is a flowchart demonstrating control over drivelines and particular to the second embodiment.
Figure 13B:
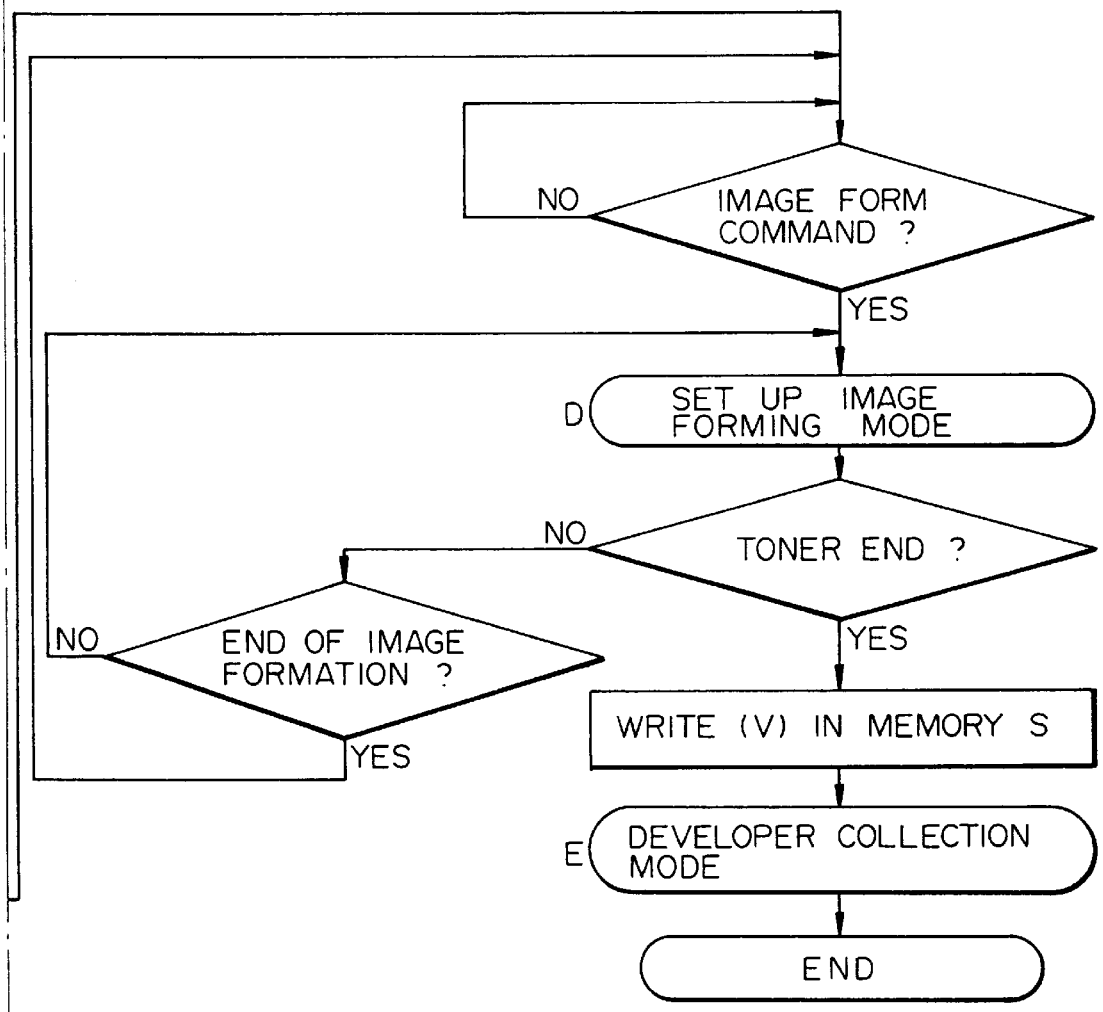

FIG. 13 demonstrates basic control to be executed by the controller 101. As shown, when the developer is introduced into the developing unit 54 for the first time, the controller 101 determines, based on the output of the cartridge sensor 102, whether or not the developer cartridge 210 is mounted. If the cartridge 210 is present, the controller 101 updates data stored in a memory S and jumps to a step A (I). The memory S is implemented as a EP-ROM, mechanical counter or similar rewritable static memory. The memory S is initially in its cleared state. After the start of operation, preselected contents are read out of the memory S in order to start a sequence. When the power is down and then up during the course of sequence, the steps already done are omitted.

In the step A, the controller 10 causes the drivelines 103, 106 and 107 to operate for delivering the developer from the cartridge 210 to the developing unit 54. The cartridge 210 stores a developer in an amount (reference amount) short of an amount necessary for the developing device 54 to start operating by an amount in which the developer is stored in the cartridge 10; the necessary amount is sufficed by the developer of the cartridge 210 and that of the cartridge 10. The controller 101 maintains the drivelines 103, 106 and 107 operative for a preselected period of time necessary for substantially the entire developer to be discharged from the cartridge 210. If desired, the preselected period of time may be simply counted in order to omit the sensing means. On the elapse of the preselected period of time, the controller 101 writes the jump to a step B (II) in the memory S and then causes the drivelines 103, 106 and 107 to stop operating.

Assume that the cartridge 210 is removed and replaced with the cartridge 10, as determined by the controller 101.

Then, the controller 101 writes a jump to a step S (III), again renders the drivelines 103, 106 and 107 operative to feed the developer from the cartridge 10, and then sets up a mode for effecting usual image formation. Before setting up the image forming mode, the controller 101 should preferably maintain the drivelines 103, 106 and 107 operative until the developer in the developing unit 54 has been sufficiently agitated. After stopping the operation of the drivelines 103, 106 and 107, the controller 101 writes a jump to a step D (IV) in the memory S. Thereafter, image formation in the usual mode is repeated in response to image form commands. When the output of the toner end sensor 108 is representative of a toner end condition, the controller 101 writes a jump to a step E (V) in the memory S and then set up the previously mentioned developer collection mode.

The developer stored in the developer cartridge 210 may be greater than the reference amount. In such a case, the duration of operation of the drivelines 103, 106 and 107 is so adjusted as to control the amount of developer supply, as will be described later with reference to FIG. 16. The residual developer may be discarded or recycled, as desired.

Figure 14:
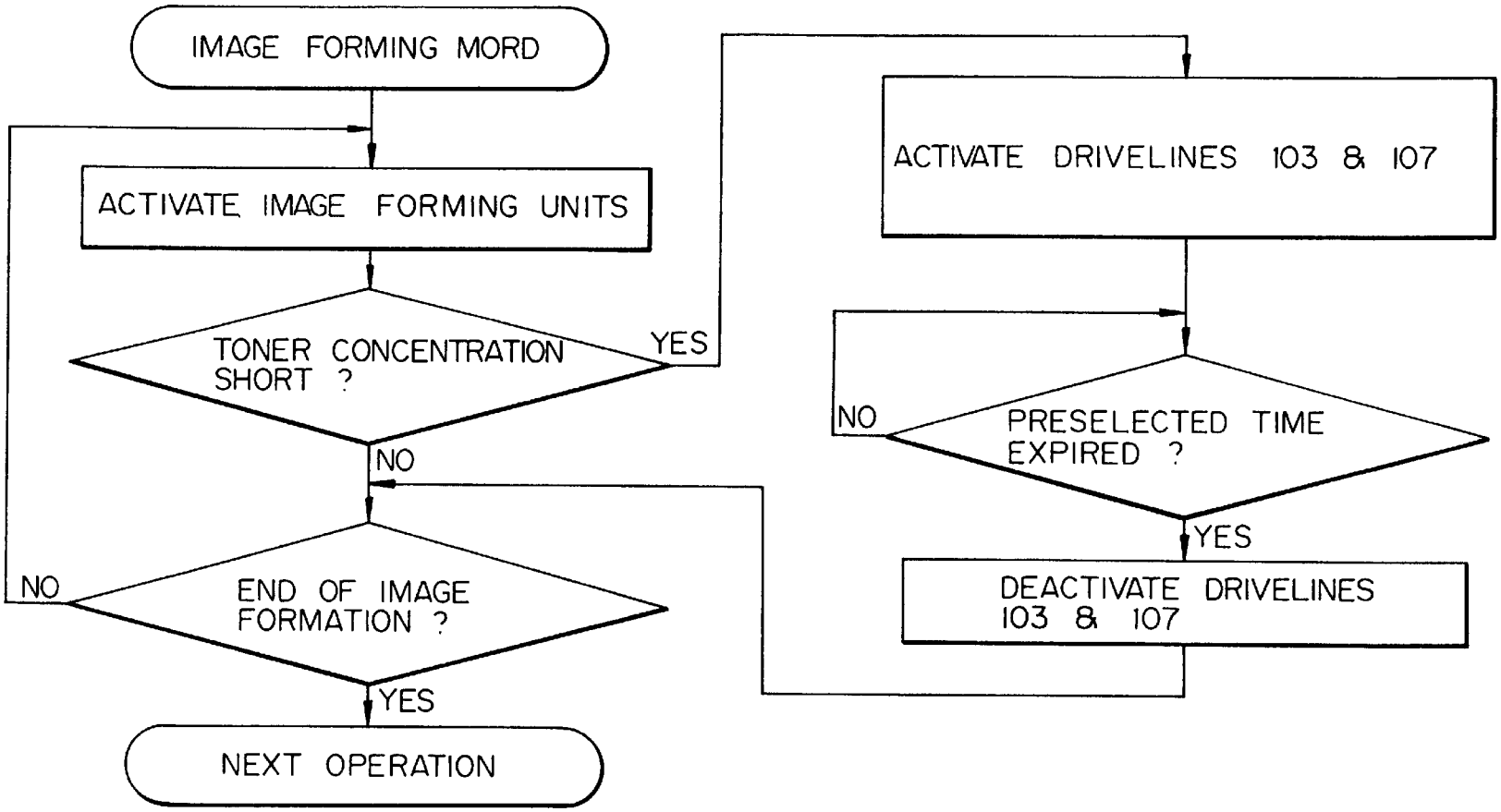
FIG. 14 is a flowchart representative of basic control to be executed in an image forming mode.

FIG. 14 shows basic control to be executed by the controller 101 in the image forming mode. In this mode operation, the controller periodically determines whether or not the toner concentration of the developer is short on the basis of the output of the toner concentration sensor. When the toner concentration is short, the controller 101 renders the drivelines 103 and 107 operative so as to replenish a preselected amount of toner from the cartridge 10.

Figure 15:
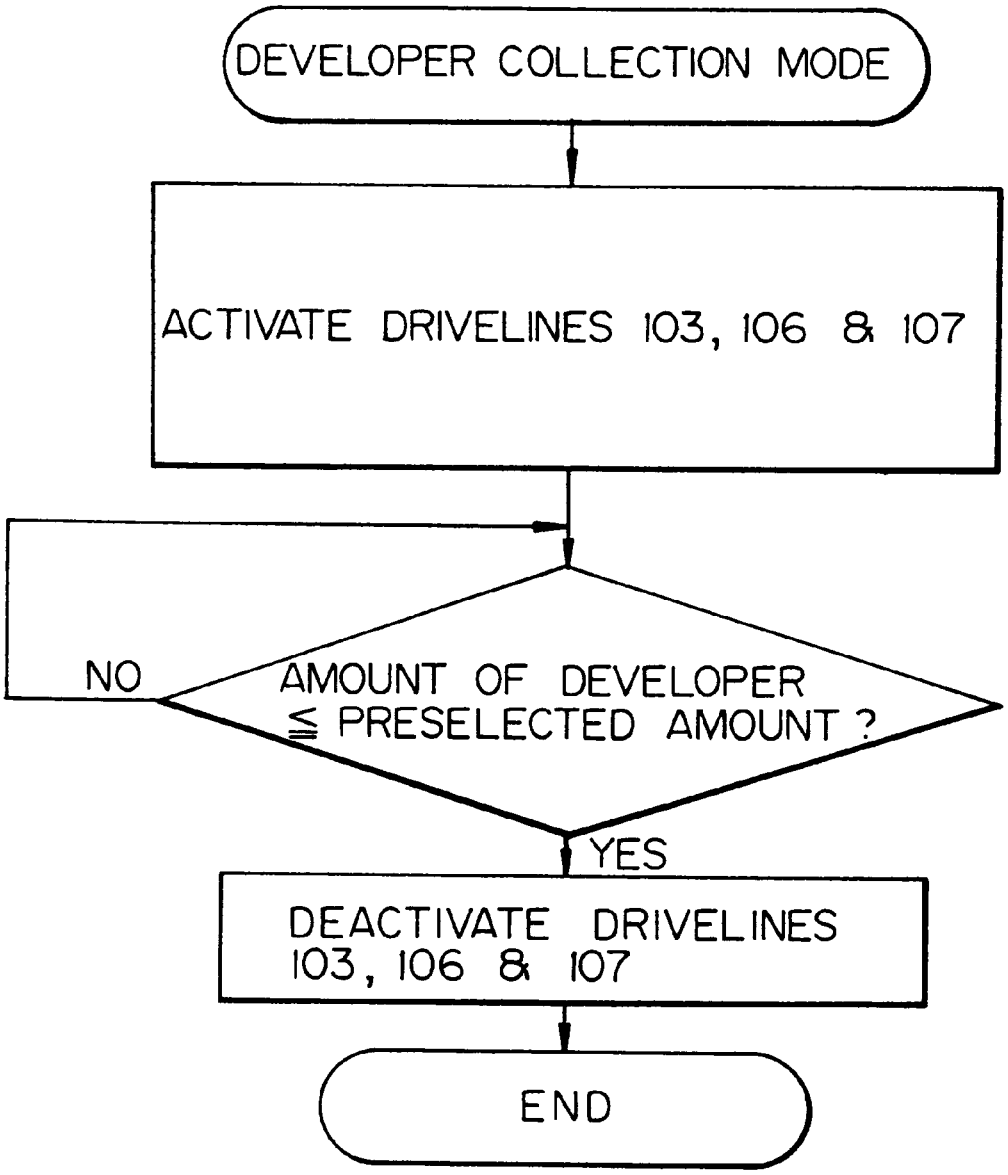
FIG. 15 is a flowchart representative of control to be executed in a developer collection mode.

FIG. 15 demonstrates the developer collection mode. As shown, the controller 101 causes the drivelines 103, 106 and 107 to operate. The screw included in the discharging device 21 discharges a part of the developer being circulated in the developing unit 54 to the cartridge 10. Monitoring the output of the developer sensor 111, the controller 101 stops the operation of the drivelines 103, 106 and 107 on determining that the amount of the developer in the developing device 54 has decreased to below a preselected amount.

As stated above, in the illustrative embodiment, the developer cartridge 210 is mounted on the apparatus body at first so as to supply its developer. This allows the apparatus to be initialized without resorting to an exclusive mechanism or expert knowledge. The controller 101 estimates a period of time necessary for the developer to be fully supplied from the cartridge 210, and stops the operation of the conveying means when the above period of time expires. This insures the supply of the reference amount of developer without resorting to exclusive sensing means. The recess 211 for distinguishing the cartridges 210 and 10 may, of course, be replaced with a particular color or a particular material forming the surface of the cartridge. This prevents a person from mounting an inadequate cartridge by accident.

Figures 16, 16A:
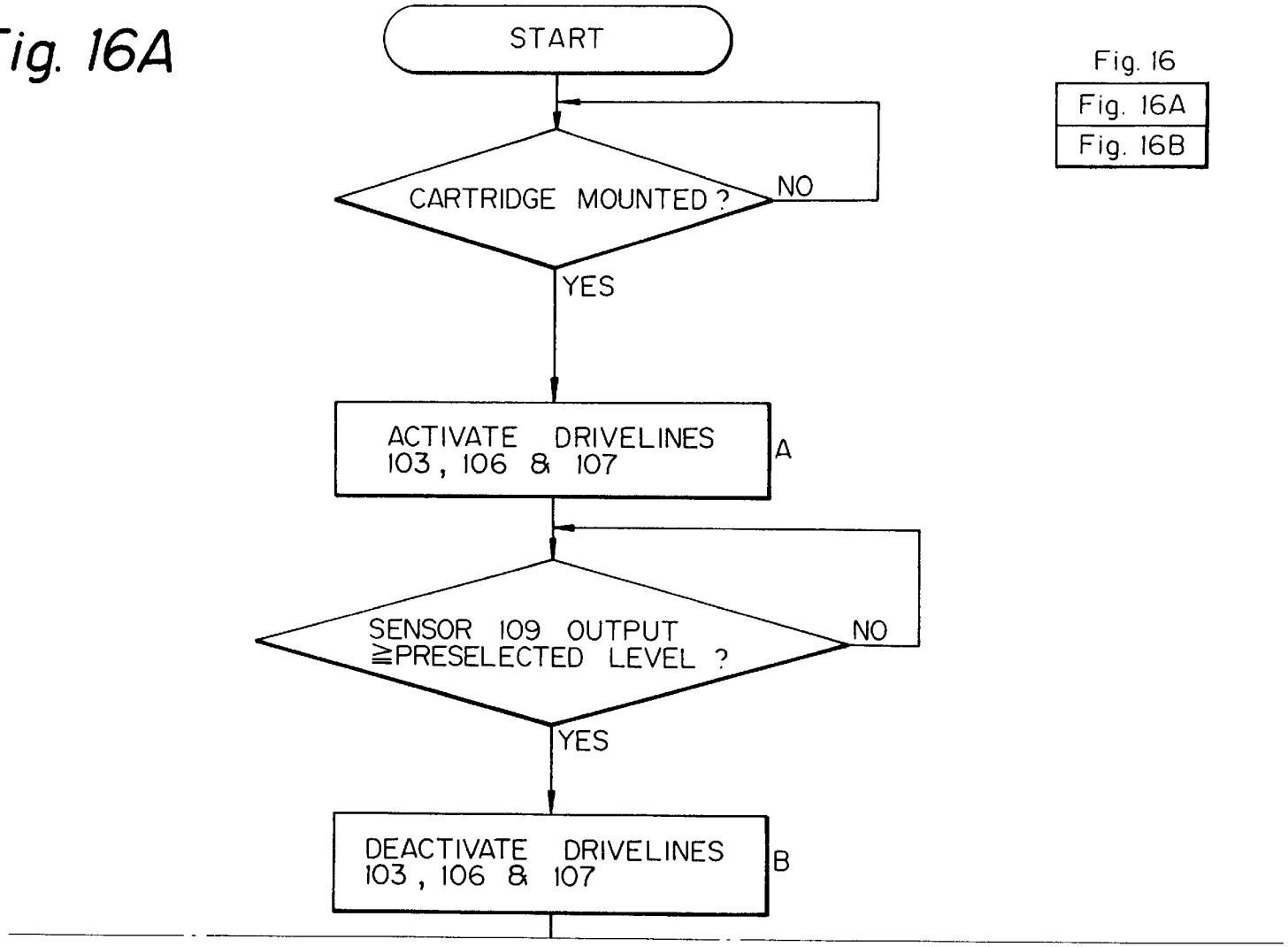
FIG. 16 is a flowchart showing control over the drivelines to be executed when a developer sensor is used.
Figure 16B:
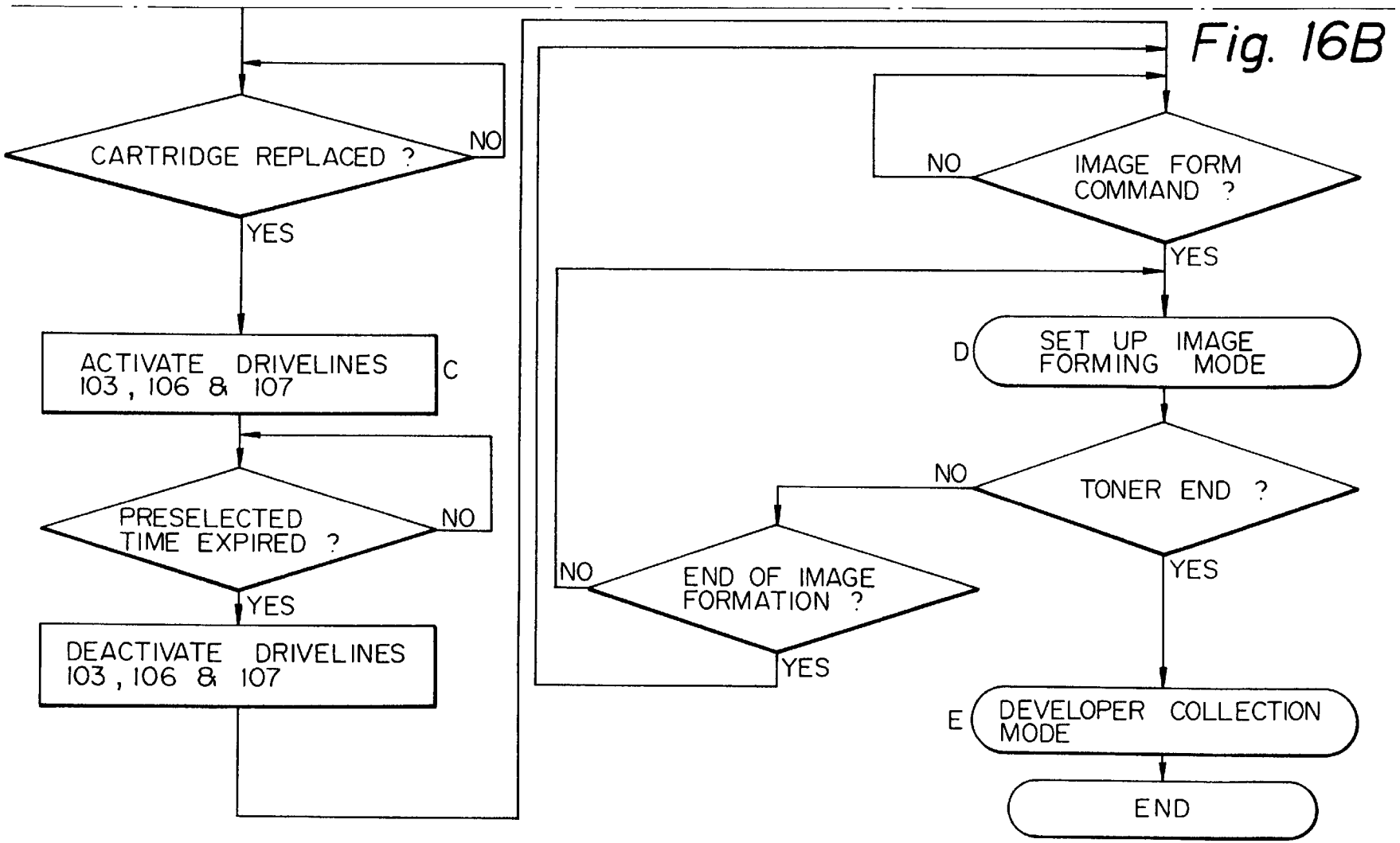

FIG. 16 shows control to be executed by the controller 101 when the developer cartridge 210 stores the developer in an amount greater than the reference amount. This control is basically similar to the control described with reference to FIG. 13 as to the updating of the memory S. As shown, assume that the controller 101 monitoring the output of the developer sensor 109 determines that the developer in the developing unit 54 has reached the reference amount (preselected level). Then, the controller 101 stops the developer supply from the cartridge 210. In this condition, the operator removes the cartridge 210 and mounts the cartridge 10 instead. In response, the controller 101 renders the drivelines 103, 106 and 107 operative in order to deliver the developer from the cartridge 10 to the developing device 54. On the elapse of the preselected period of time, the controller 101 sets up the mode for ordinary image formation. Thereafter, image formation in the usual mode is repeated in response to image form commands. When the output of the toner end sensor 108 is representative of a toner end condition, the controller 101 sets up the developer collection mode. With this configuration, it is possible to surely detect the amount of the developer existing in the developing unit 54 and therefore to supply the developer in an exact amount. This prevents the developer from dropping from the developing unit 54 and obviates malfunction, short or irregular toner concentration and other troubles.

Figure 17A:
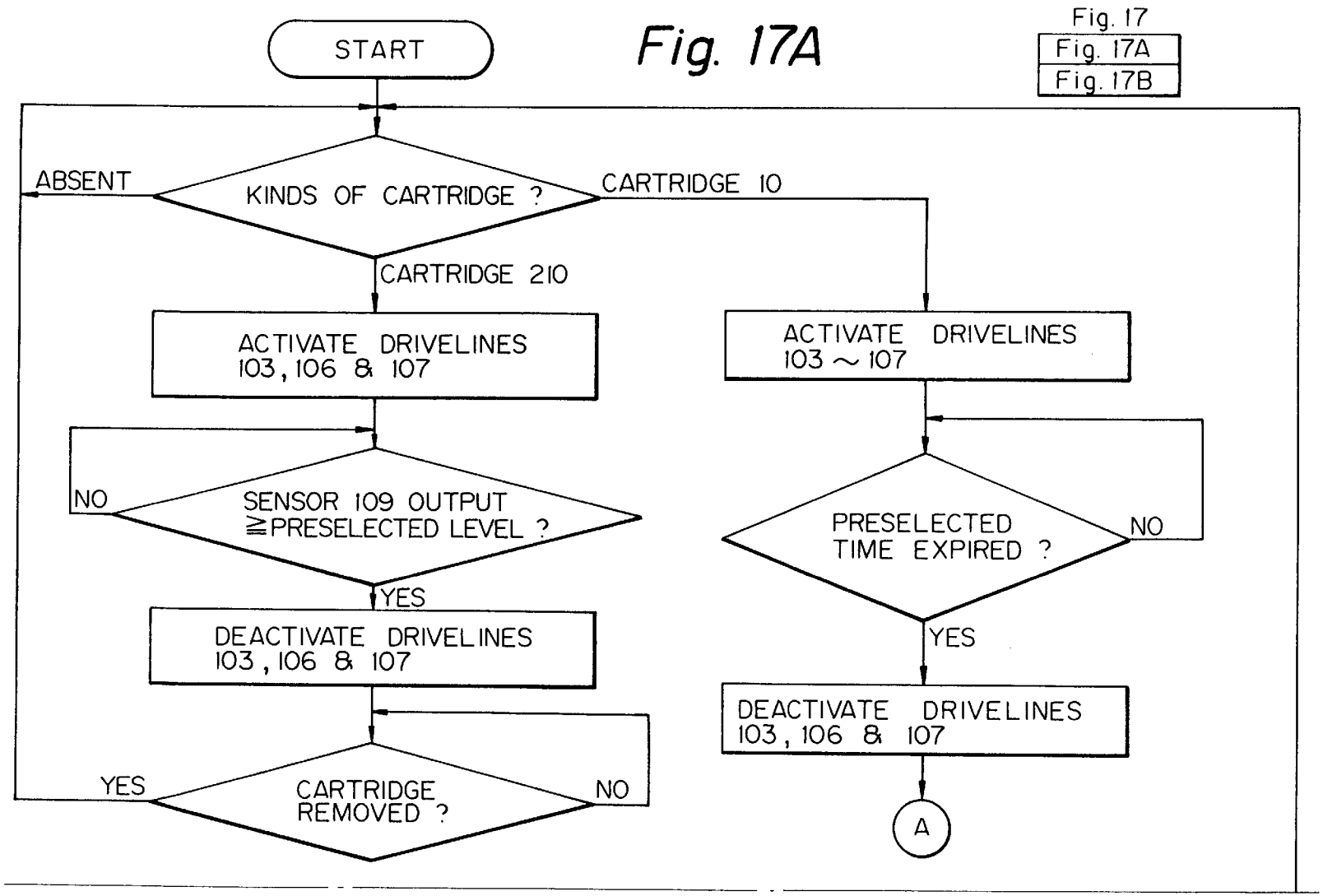
FIG. 17 is a flowchart showing control over the drivelines to be executed when means for identifying a cartridge is used.
Figure 17B:
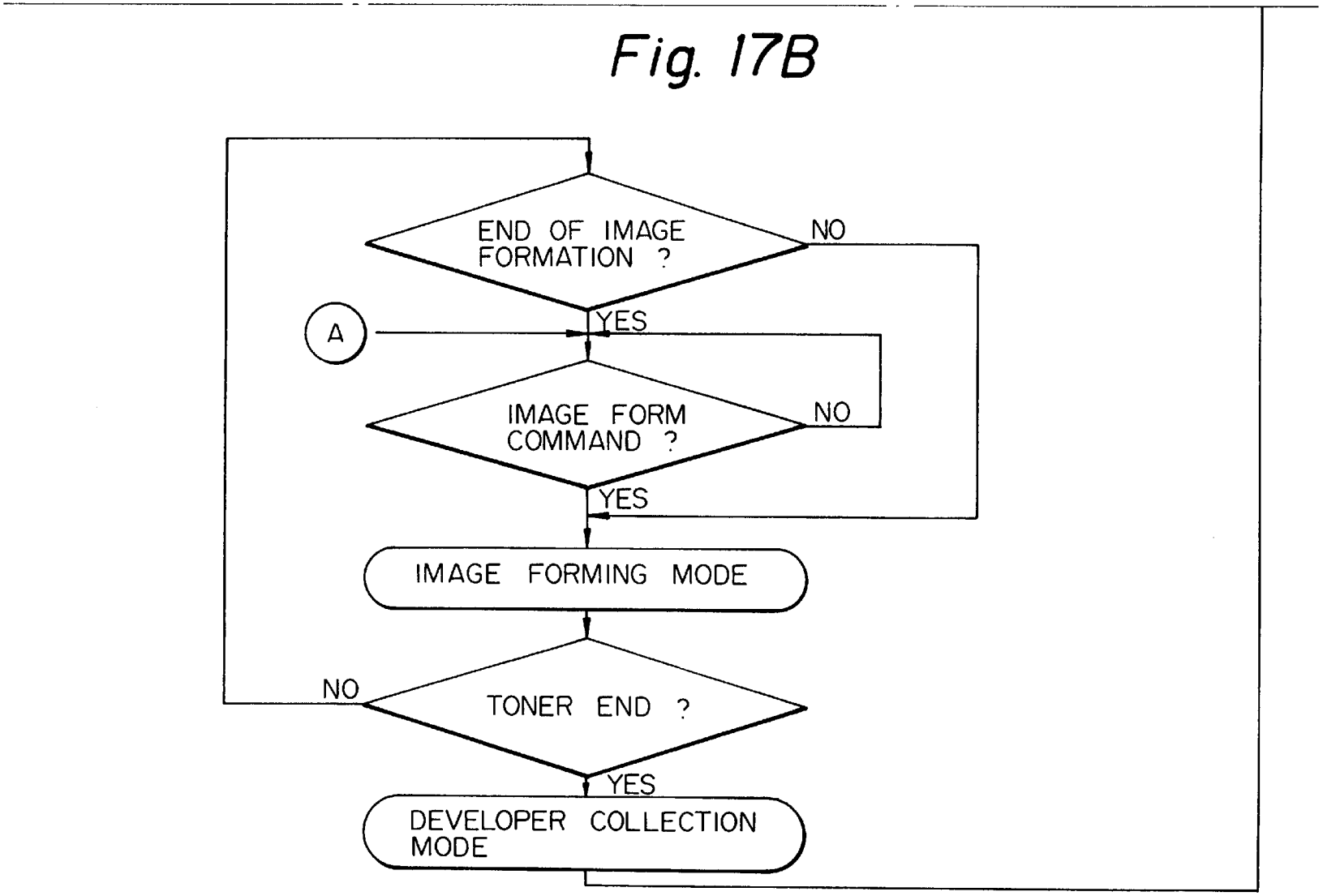

FIG. 17 shows control to be executed by the controller 101 when the apparatus body includes means for identifying the recess 211 of the developer cartridge 210. This control is also basically similar to the control described with reference to FIG. 13 as to the updating of the memory S. The identifying means is implemented as, e.g., a mechanical microswitch or an optical reflection density sensor. The content of control of the controller 101 is changed on the basis of the result of identification.

As shown in FIG. 17, the developer cartridge 210 with the recess 211 is mounted to the apparatus body, as detected by the identifying means, the controller 101 starts the supply of the developer from the cartridge 210 to the developing unit 54. This is the same as the initial developer supply described with reference to FIG. 13. After the developer has been delivered from the cartridge 210, he operator removes the cartridge 210 and mounts the cartridge 10 instead. On determining that the cartridge 10 has been mounted, the controller 101 renders the drivelines 103, 106 and 107 operative for delivering the developer from the cartridge 10 to the developing unit 54. On the elapse of the preselected period of time, the controller 101 sets up the image forming mode. After the repetition of image formation, the controller 101 determines that the cartridge 10 has run out of toner on the basis of the output of the toner end sensor 108. Then, the controller 101 sets up the developer collection mode and awaits the mounting of a cartridge.

Preferably, an arrangement is made such that when the cartridge 10 is mounted at the time of initial developer supply or when the cartridge 210 is mounted after the supply of the preselected amount of developer to the developing unit 54, an alarm is produced. As stated above, with the identifying means, it is possible to obviate malfunction ascribable to an inadequate cartridge.

Figure 18A:
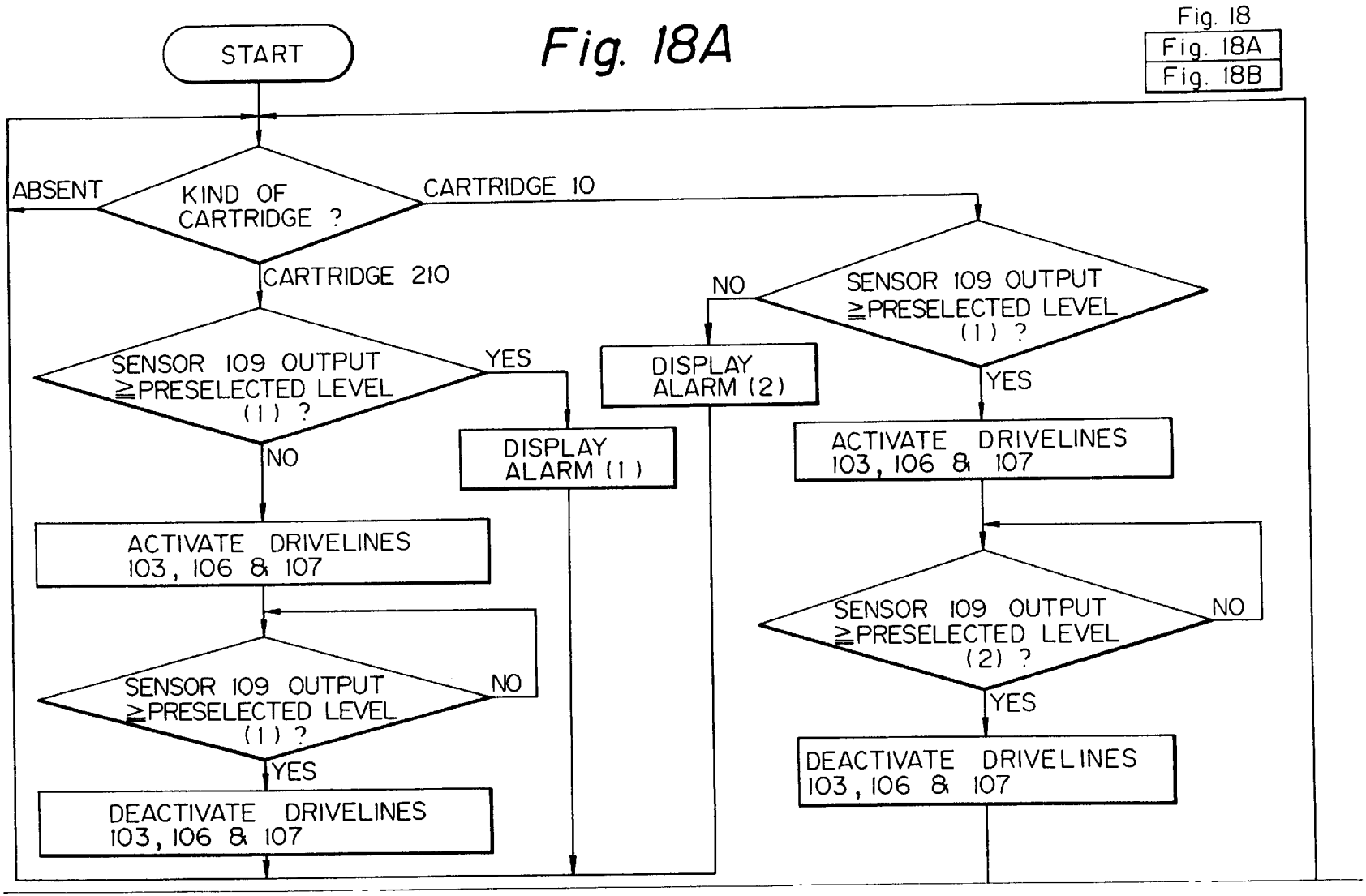
FIG. 18 is a flowchart showing control which inhibits, based on the amount of the developer in a developing unit, the drivelines from operating when an inadequate cartridge is mounted.
Figure 18B:
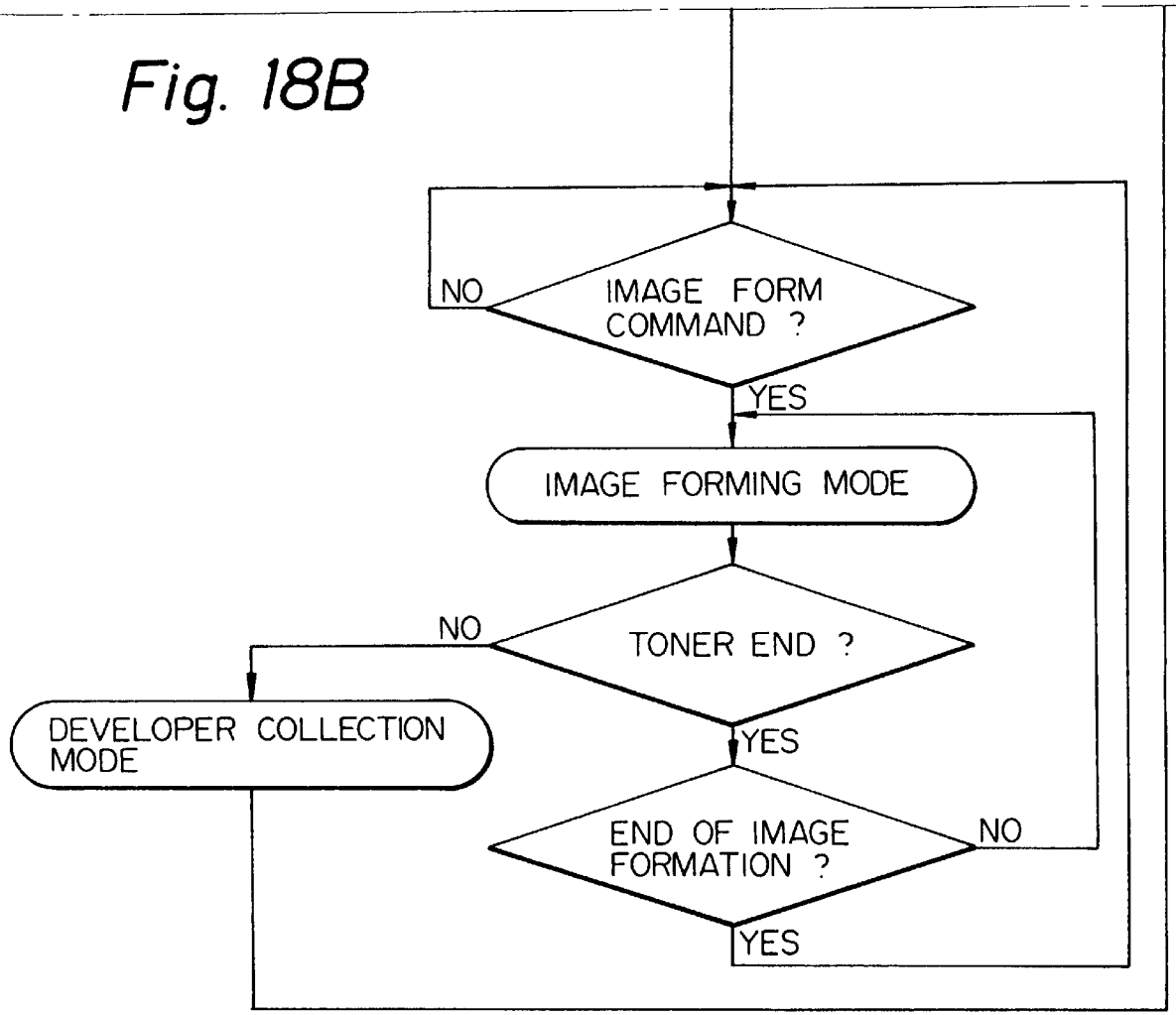

FIG. 18 shows a procedure constituting an improvement over the procedure of FIG. 17. Again, the steps relating to the updating of the memory S are not shown or described in order to avoid redundancy. As shown, assume that the identifying means identifies the cartridge 210 wit the recess 211 and mounted to the apparatus body. Then, the controller 101 determines whether or not the preselected or reference amount of developer exists in the developing device 54 on the basis of the output of the developer sensor 109. If the answer of this decision is positive (Y), the controller 101 produces, e.g., a message "Developer supply from a developer cartridge has ended.", and again awaits the mounting of a cartridge. If the output of the sensor 109 shows that the amount of developer in the developing device 54 is short of the reference amount, then the controller 101 causes the drivelines 103, 106 and 107 to operate for delivering the developer from the cartridge 210. When the developer in the device 54 reaches its reference level, as determined by the sensor 109, the controller 101 deactivates the drivelines 103, 106 and 107 in order to end the developer supply, and again awaits the replacement of the cartridge.

Assume that the cartridge 10 is mounted to the apparatus body. Then, the controller 101 determines whether or not the reference amount of developer exists in the developing unit 54. If the answer of this decision is negative (N), the controller 101 produces an alarm message and again awaits the loading of a cartridge. If the answer of the above decision is positive, the controller 101 activates the drivelines 103, 106 and 107 and then deactivates them when the amount of developer necessary for image formation is reached. In this condition, image formation is repeated in response to image form commands. When the cartridge 10 runs out of toner, the controller 101 executes the developer collection mode and awaits the loading of a cartridge. In this manner, the controller compares the amount of developer existing in the developing unit 54 with the kind of the cartridge and inhibits the drivelines 103, 106 and 107 from operating if the cartridge is inadequate. This obviates various troubles ascribable to the short or excessive developer.

Figure 19A:
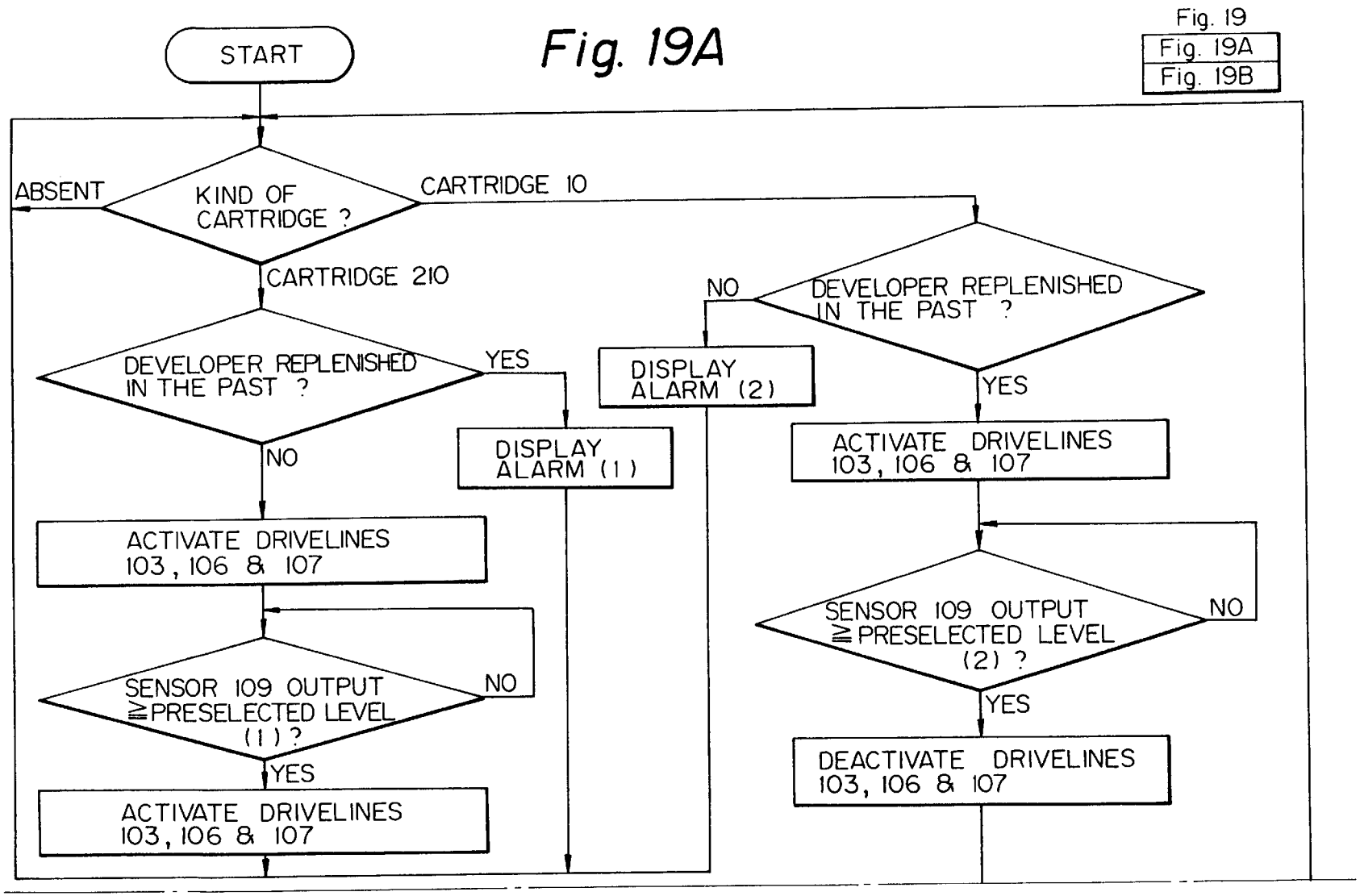
FIG. 19 is a flowchart showing control which inhibits, based on an operation history, the drivelines from operating when an inadequate cartridge is mounted.
Figure 19B:
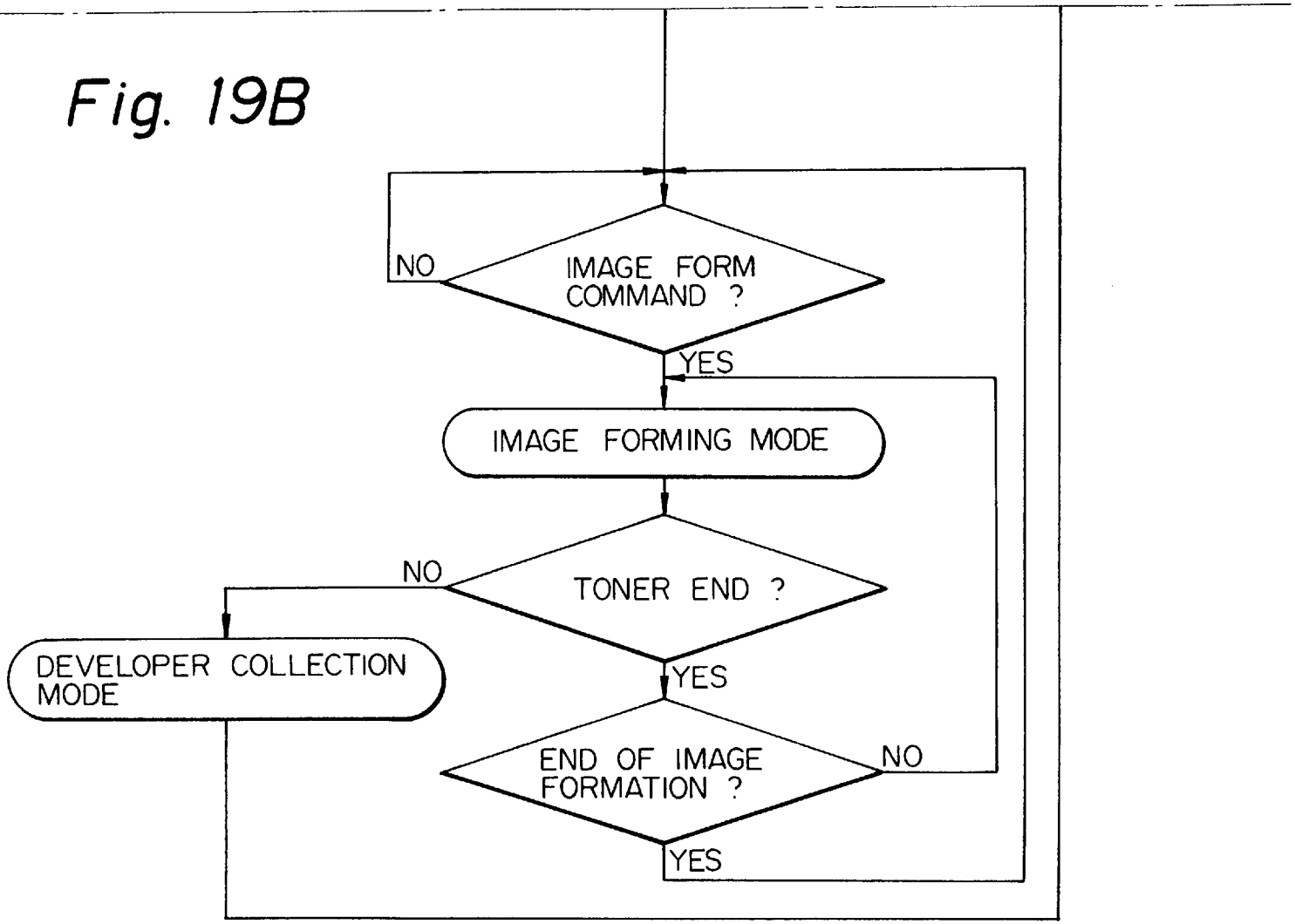

FIG. 19 demonstrates a procedure available with the controller 101 when it includes a memory capable of storing an operation history. Again, the steps relating to the updating of the memory S will not be shown or described in order to avoid redundancy. Briefly, in the procedure to be described, information showing whether or not the developer has been fed from the developer cartridge 210 is written to a memory, so that the operation control method can be changed on the basis of the information. As shown in FIG. 19, when a cartridge is mounted to the apparatus body, the identifying means determines the kind of the cartridge. If the cartridge is the developer cartridge 210, the controller 101 checks the above memory to see if the developer for the initial operation has already been supplied. If the answer of this decision is positive, the controller 101 produces an alarm message showing that the developer is present, and then awaits for the mounting of a cartridge. If the output of the developer sensor 109 shows that the amount of developer is short of the preselected amount, the controller 101 causes the drivelines 103, 106 and 107 to operate for delivering the developer from the cartridge 210. When the preselected amount of developer is reached, the controller 101 deactivates the drivelines 103, 106 and 107 to end the developer supply and then awaits the replacement of the cartridge.

When the cartridge 10 is mounted to the apparatus body, the controller 101 checks the history stored in the memory. If the history shows that the developer supply for the initial operation has not been effected yet, the controller 101 produces an alarm message and again awaits the mounting of a cartridge. If the answer of the above decision is positive, the controller 101 renders the drivelines 103, 106 and 107 operative and then renders them inoperative when the developer reaches an amount sufficient for image formation. Subsequently, in response to an image form command, the controller 101 executes the image forming mode and repeats it until image formation ends. When the cartridge 10 runs out of toner, the controller 101 executes the developer collection mode and again awaits the mounting of a cartridge. In this manner, the controller 101 writes the operation history in the memory and allows the usual image forming operation to be effected only after the mounting of the developer cartridge 210. This also successfully obviates malfunction.

As stated above, with this embodiment, it is possible to initialize the apparatus easily without resorting to any additional mechanism. The embodiment is free from troubles including defective images and attributable to the short or excessive developer. Also, adequate supply is insured when cartridges are repeatedly mounted. Further, because the supply is not effected if the cartridge mounted to the apparatus body is inadequate, troubles ascribable to the inadequate cartridge are obviated.

3rd Embodiment

Figure 20:
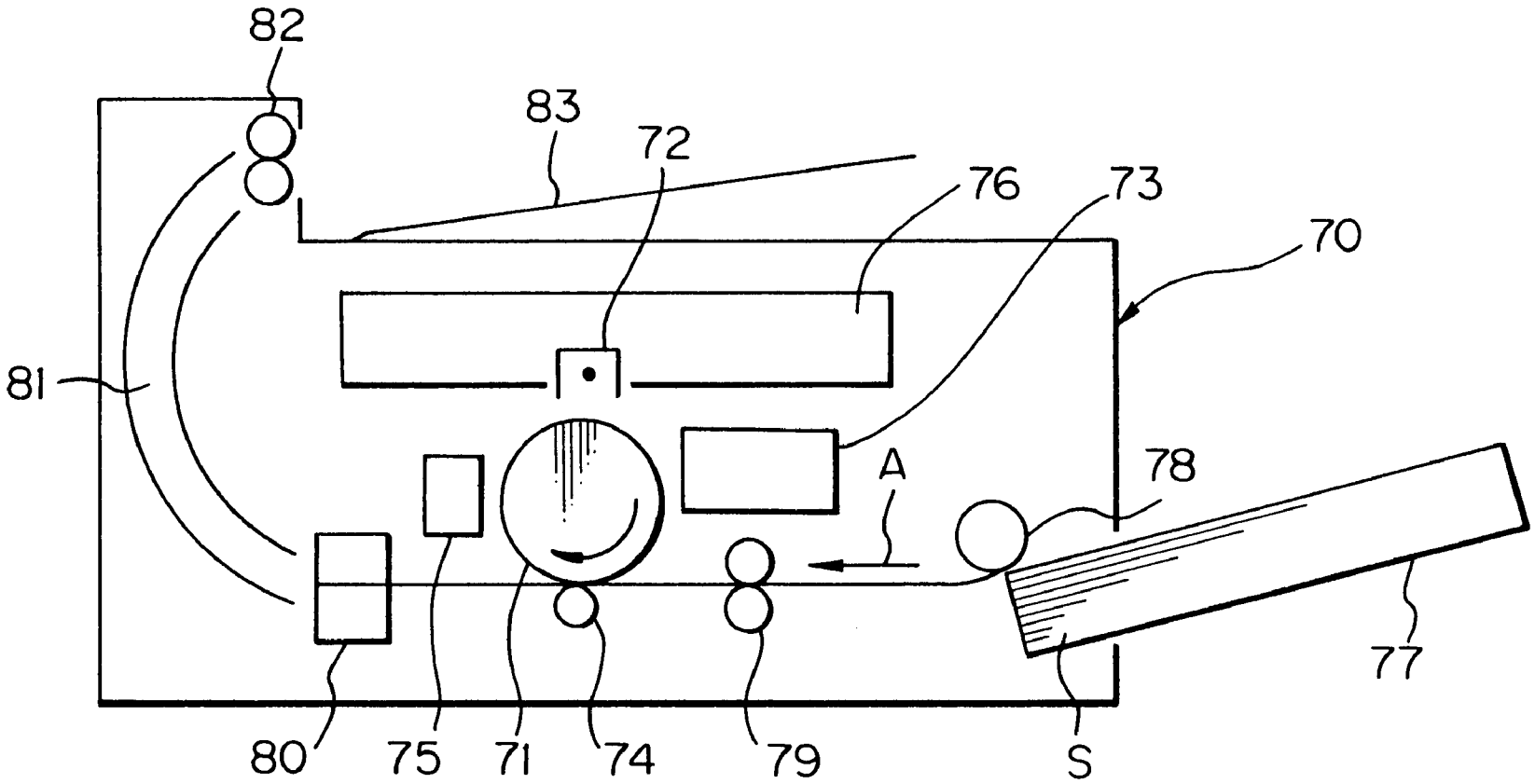
FIG. 20 shows a laser printer representative of a third embodiment of the present invention.

Referring to FIG. 20, a laser printer including a third embodiment of the present invention is shown. As shown, the printer has a body 70 and a photoconductive drum 71 located at substantially the center of the body 70. Arranged around the drum 71 are a main charger 72, a developing unit 73, an image transfer unit 74, and a cleaning unit 75 as named in the direction of rotation of the drum 71 which is indicated by an arrow. An optical writing unit 76 is positioned above the main charger 72, developing unit 73, and cleaning unit 74. A sheet cassette 77 loaded with a stack of sheets S is removably mounted on the right end of the body 10, as viewed in FIG. 20.

The laser printer forms an image on the sheet S, as follows. A pick-up roller 78 is rotated to feed the sheet S from the cassette 77 in a direction indicated by an arrow A in FIG. 20. A registration roller pair 79 drives the sheet S to below the drum 71 at a predetermining timing. While the drum 71 is rotated clockwise as indicated by an arrow, the main charger 72 charges the surface of the drum 71 uniformly. The writing unit 76 scans the charged surface of the drum 71 with a laser beam in order to form an electrostatic latent image. When the latent image is brought to a position where it faces the developing unit 73, the unit 73 develops it with toner to thereby form a corresponding toner image. The image transfer unit 74 transfers the toner image from the drum 71 to the sheet brought to below the drum 71. The fixing unit 80 fixes the toner image on the sheet S. Finally, the sheet S is driven out of the apparatus body 70 along a transport path and then stacked on a tray 83 by a roller pair 82. The toner remaining on the drum 71 after the image transfer is removed by the cleaning unit 75.

Figure 21:
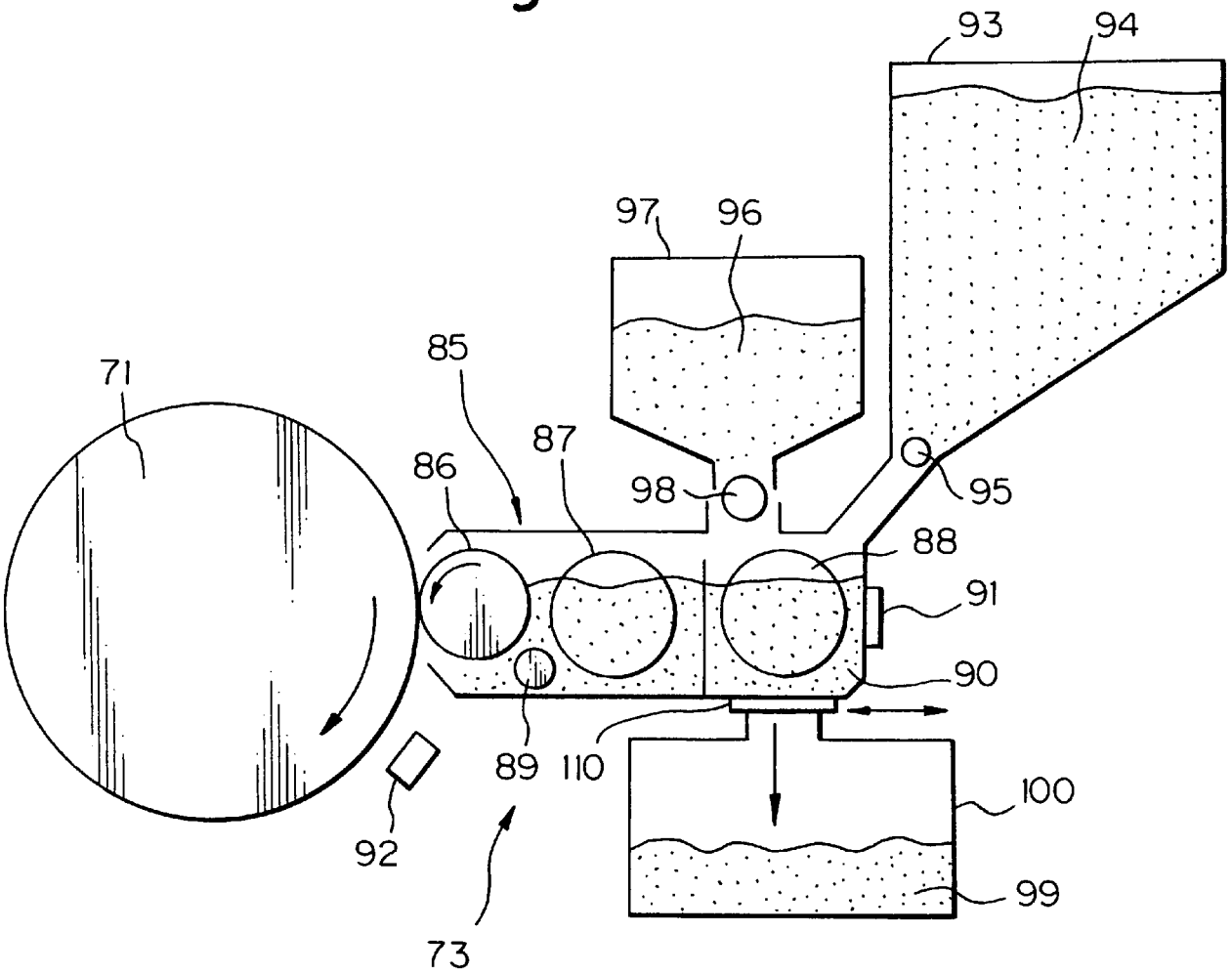
FIG. 21 shows a developing device included in the third embodiment and for replacing a developer.

FIG. 21 shows the developing unit 73 in detail. As shown, the developing unit 73 includes a casing 85 accommodating a developing sleeve 86, screws 87 and 88, and a paddle 89. The developer circulated by the screws 87 and 88 is fed to the developing sleeve 86 by the paddle 89 and forms a magnet brush on the sleeve 86. Only the toner is electrostatically deposited on the latent image on the drum 71.

The development of the latent image should be effected in a condition providing the optimal amount of charge. For this purpose, toner and carrier constituting a developer 90 and existing in the casing 85 is maintained in a constant ratio determined by the developer used. Let this kind of control be referred to as toner concentration control. The toner concentration control is executed by a magnetic sensor 91, a reflection type density sensor 92, etc. These sensors will be collectively referred to as toner concentration sensors. In actual control, a toner concentration in the casing 85 is determined in terms of a relation between the output voltages of the toner concentration sensor and a preselected toner concentration. A toner replenish roller 95 is rotated in a variable amount based on the determined toner concentration, so that a necessary amount of toner 94 is replenished from a toner cartridge 93.

A developer container 97 stores fresh developer, i.e., toner and carrier mixture 96 and is removably mounted to the casing 85. The container 97 may be loaded with the developer 96 in an amount sufficient only for a single replacement. Alternatively, the amount of the developer 96 may suffice several times of replacement or may even correspond to the service life of the apparatus body 70. A developer replenish roller 98 adjoins the outlet of the container 97 and is rotatable to replenish the developer 96. The amount of developer replenishment is determined by the amount of rotation of the roller 98.

A waste toner container 100 is removably mounted to the bottom of the casing 85 in order to collect a used or waste developer 99. The container 100 may have its size determined in the same manner as the size of the developer container 97. When the container 100 has a size corresponding to several times of replacement, the size should preferably correspond to the amount of the fresh developer 96. This allows the containers 100 and 97 to be replaced at the same timing. A shutter 110 is mounted on the bottom of the casing 85 and opened in the event of collection of the used developer. The duration of opening of the shutter 110 is maintained constant in order to collect a constant amount of developer at all times. If desired, the exclusive waste toner container 100 may be omitted, in which case the waste toner will be collected in the developer container 97. Further, use may be made of the previously stated container 10 for the collection of the used toner.

The operation of the illustrative embodiment will be described hereinafter. Generally, a developer deteriorates at a rate substantially proportional to the number of copies produced, while toner is consumed in an amount depending on the amount of image information to be copied and the number of copies. Therefore, the user copying documents with much image information must replenish fresh toner more often than the user copying documents with little image information. However, if a small amount of developer is replaced when the toner cartridge 93 runs out of fresh toner and is replaced, it is possible to replace the containers 97 and 93 at the same time while maintaining a stable degree of fatigue, and thereby to free the user from troublesome work. In light of this, the illustrative embodiment collects the used developer at the time of replacement of the toner cartridge 93, so that the developer container 97 can be replaced at the same time as the cartridge 93. In the following description, assume that the containers 97 and 100 are each replaced every time the developer is replaced.

Figure 22A:
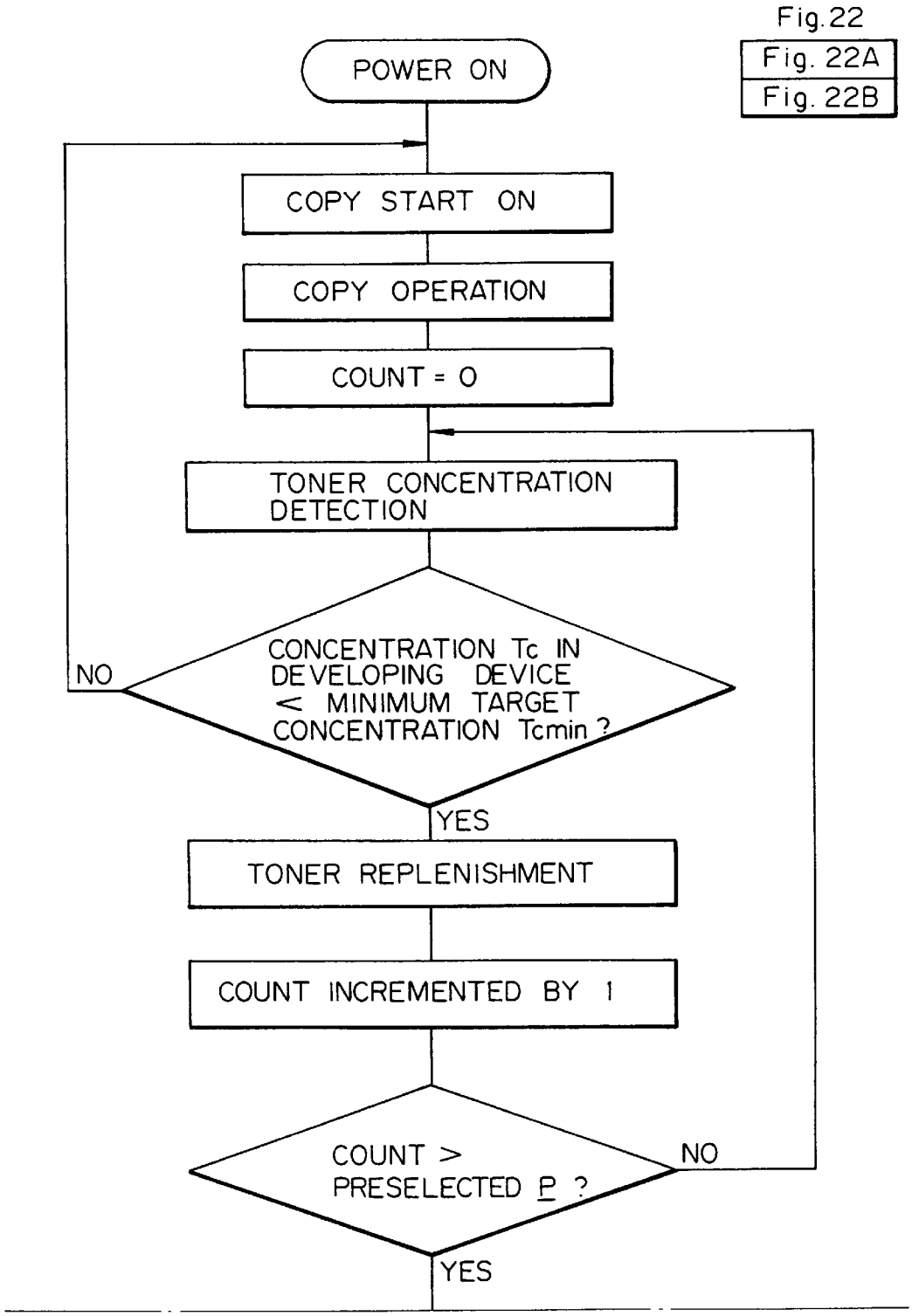
FIG. 22 is a flowchart demonstrating the collection of a used developer particular to the third embodiment.
Figure 22B:
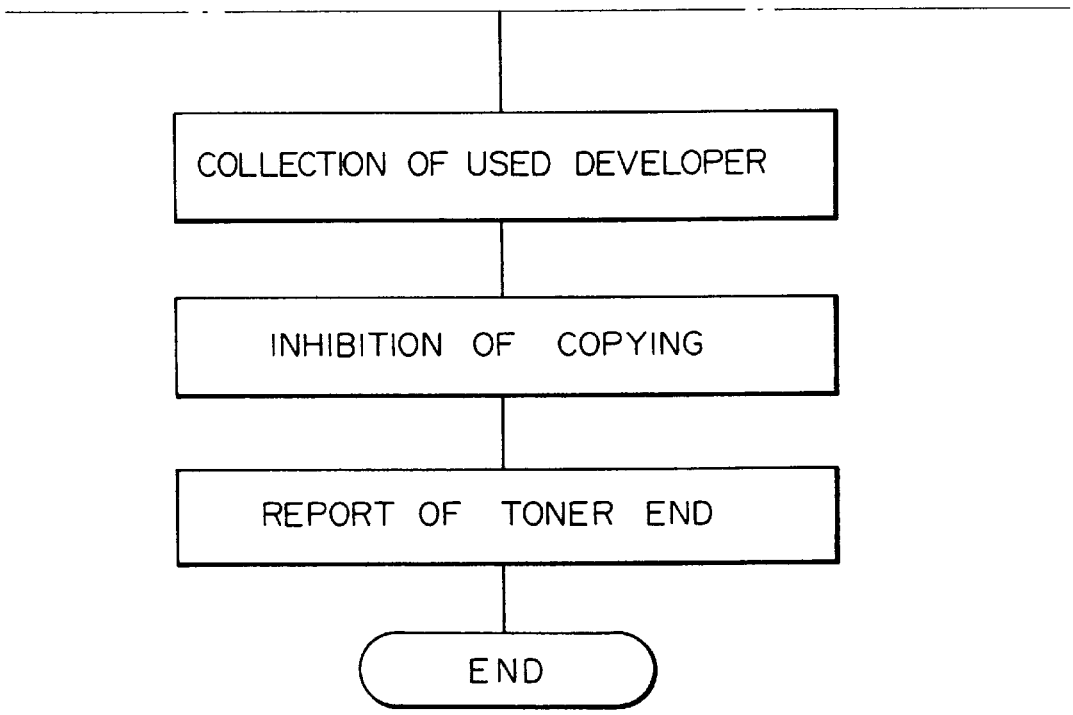

FIG. 22 shows how the used developer is collected in the container 100. As the copying operation is repeated in a power up condition, the toner is sequentially consumed with the result that the toner concentration of the developer in the casing 85 sequentially decreases. When the toner concentration sensor determines that the toner concentration has decreased to below the minimum value of a target control range, a toner replenish signal is fed to the replenish roller 95. In response, the roller 95 is rotated to replenish the toner from the cartridge 93 into the casing 85. As the toner replenishment is repeated, the amount of toner remaining in the cartridge 93 sequentially decreases. As a result, the developer in the casing 85 fails to recover its target toner density in due course of time, although the toner replenishing operation may be effected. In light of this, the number of times of consecutive toner replenishment is counted. When the count reaches a preselected count (P times), a mode for collecting the used developer from the casing 85 is set up. This matches the time for replacing the cartridge 93 to the time for collecting the used developer.

The prerequisite is that the used developer to be collected contains the same amount of carrier as the fresh developer to be replenished at a time. The toner concentration of the used developer is relatively low, i.e., the ratio of the carrier is higher than that of carrier of a developer having an adequate toner concentration. Therefore, if the carrier to be collected and the carrier to be replenished are of the same amount, then the amount of the developer collected is smaller than that of the fresh developer replenished. The amount of the developer to be collected is grasped beforehand and controlled on the basis of the duration of opening/closing of the shutter 110. It is to be noted that when the developer in the casing 85 recovers the target toner concentration before the count reaches P, the count is reset to zero.

While the copying operation ay be inhibited during toner collection, it may be effected during toner collection because it does not influence the amount of carrier to be collected. After the toner collection, the copying operation is inhibited, and the fact that the cartridge 93 has run out of toner is reported to the operator. This urges the operator to replace the cartridge 93, and in addition to replace the developer container 97 and waste toner container 100. The above report may be implemented as a visible report or an audible report, as desired.

The toner collection is executed when the toner concentration of the developer in the casing 85 decreases to below the target value, as stated above. This maintains the toner concentration at the time of collection substantially constant at a value slightly lower than the target concentration. As a result, the amount of carrier in the collected developer remains constant, and the amount of the developer in the casing 85 does not vary despite the replacement. The casing 85 is therefore free from locking due to an excessive load ascribable to an increase in the developer in the casing 85, and from defective scoop-up ascribable to a decrease in the amount of the developer. Further, because the developer to be collected has a relatively low toner concentration, it is possible to reduce the toner to be collected without being used as far as possible. In addition, when the waste toner container 100 is so sized as to match a plurality of times of developer replacement or the life of the apparatus body, the size is reduced due to the low toner concentration.

As described above, in the illustrative embodiment, the toner concentration at the time of developer replacement remains substantially constant, allowing carrier to be collected in a constant amount. This reduces the variation of the amount of developer existing in the casing 85. Further, because the developer is collected when its toner concentration is relatively low, it is possible to reduce the amount of toner to be collected without being used. Moreover, the apparatus body is prevented from stopping operating during the collection of the used developer. Specifically, if the toner end condition is reported during or before collection, then it is likely that the drivelines of the apparatus body stop operating during the automatic collection in order to replace the toner, resulting in malfunction. Reporting the toner end condition after the collection obviates such malfunction.

4th Embodiment

Figure 23:
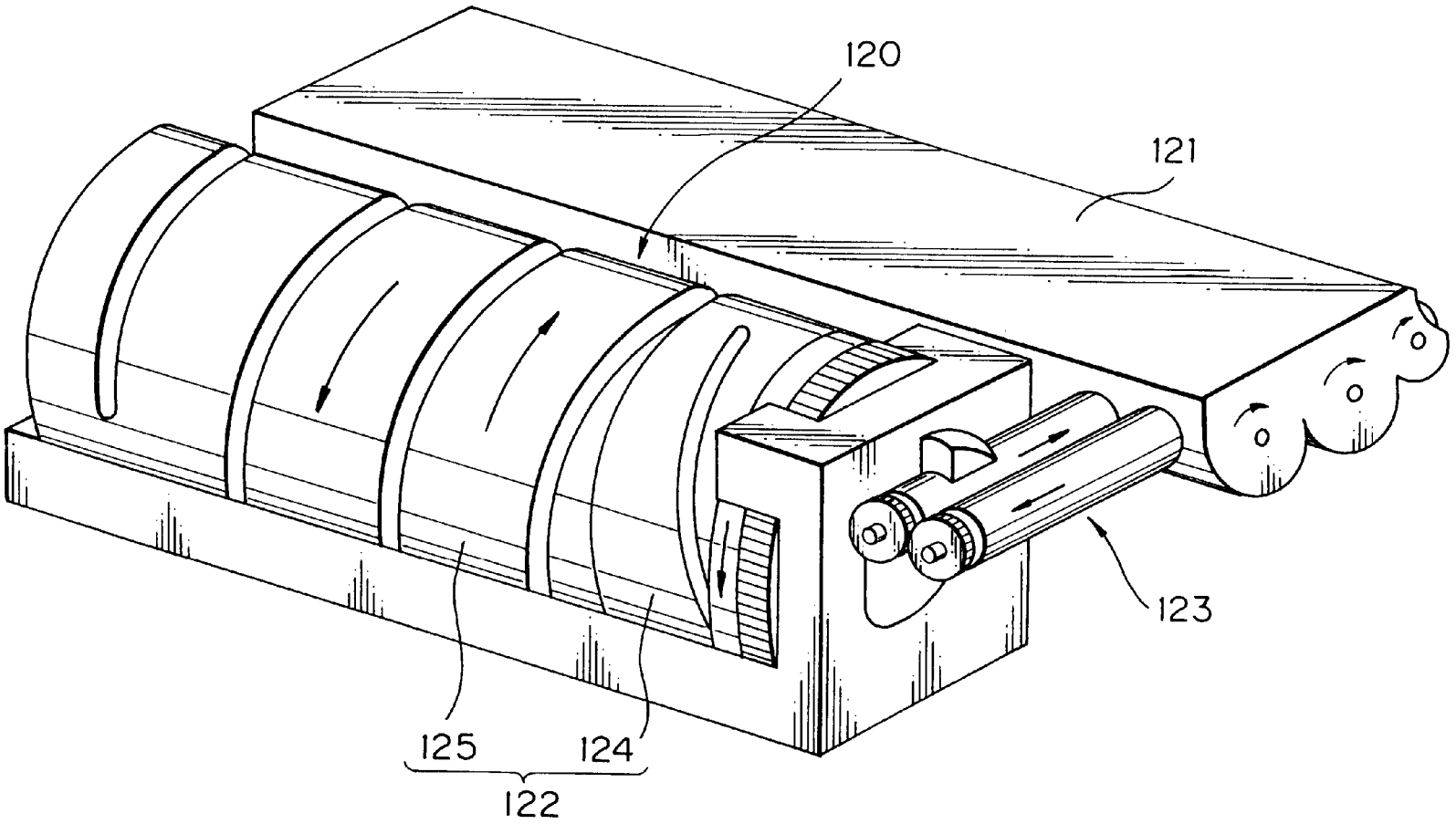
FIGS. 23 and 24 are perspective views showing a fourth embodiment of the present invention.

FIG. 23 shows a toner and developer replenishing device 120 representative of the fourth embodiment and a developing unit 121 on which the device 120 is mounted. The developing unit 121 includes a developing roller and other conventional members, not shown, for developing a latent image formed on a photoconductive element, not shown. The replenishing device 120 has a container 122 storing toner and a toner and carrier mixture or developer, and a conveyor mechanism 123. The conveyor mechanism 123 conveys the toner or the developer coming out of the container 122 to the developing device 121 or circulates the developer coming out of the device 121.

The container 122 is made up of a first container 124 and a second container 125 integrally connected to each other. The two containers 124 and 125 replenish the toner and developer at their common end face. This kind of configuration is taught in, e.g., Japanese Patent Application No. 7-171157. When the container 122 is selectively rotated in a direction A or B, spiral ridges respectively formed in the inner circumferential surfaces of the containers 124 and 125 each drives the respective powder out of the container 124 or 125. Usually, fresh developer and fresh toner are stored in the containers 124 and 125, respectively.

Figure 24:
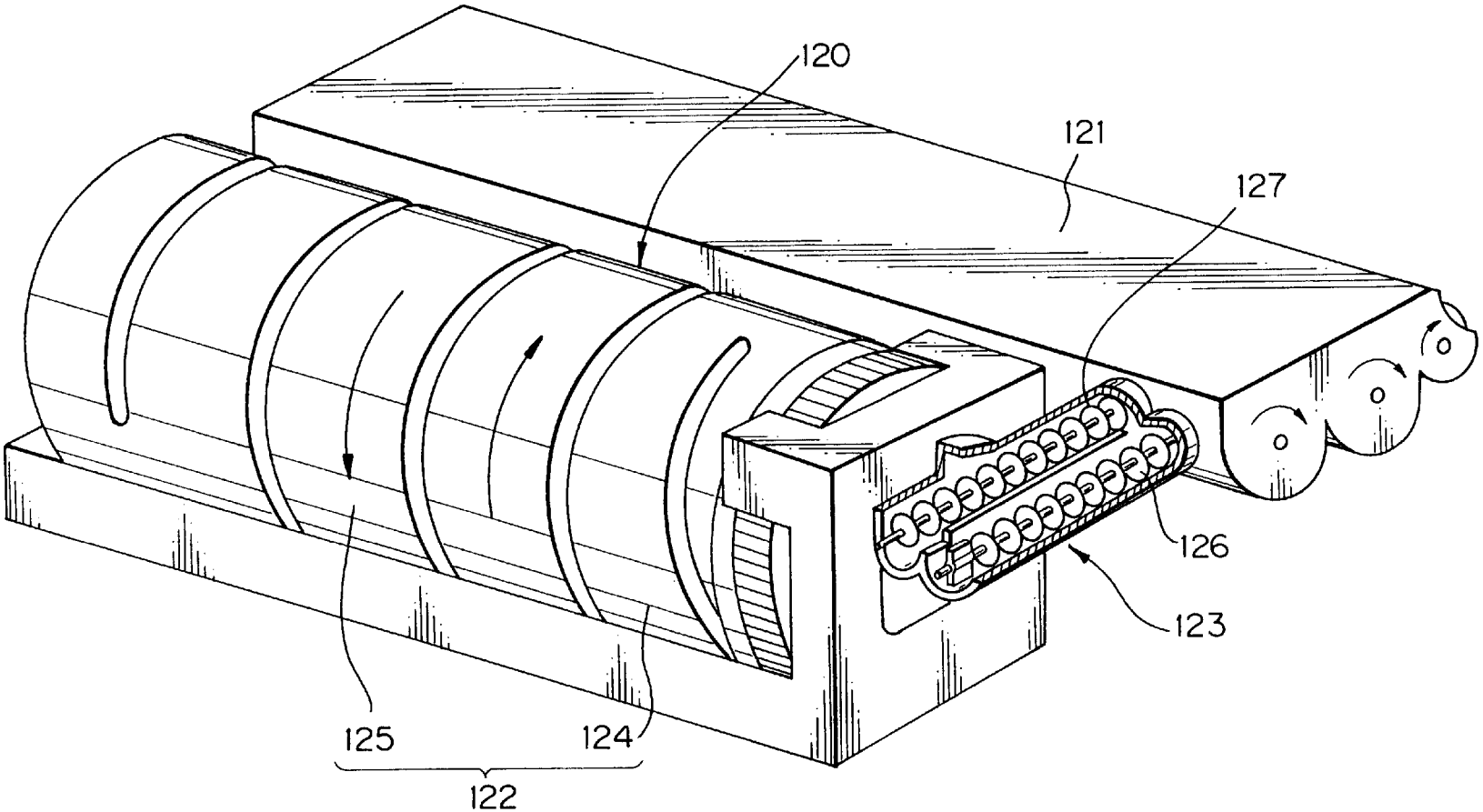

As shown in FIG. 24, the conveyor mechanism 123 includes a first and a second screw 126 and 127. The screw 126 conveys the developer coming out of the developing device 121 and hands it over to the screw 127 at the front side, as seen in FIG. 24. The screw 127 returns the developer to the developing device 121.

Figure 25:
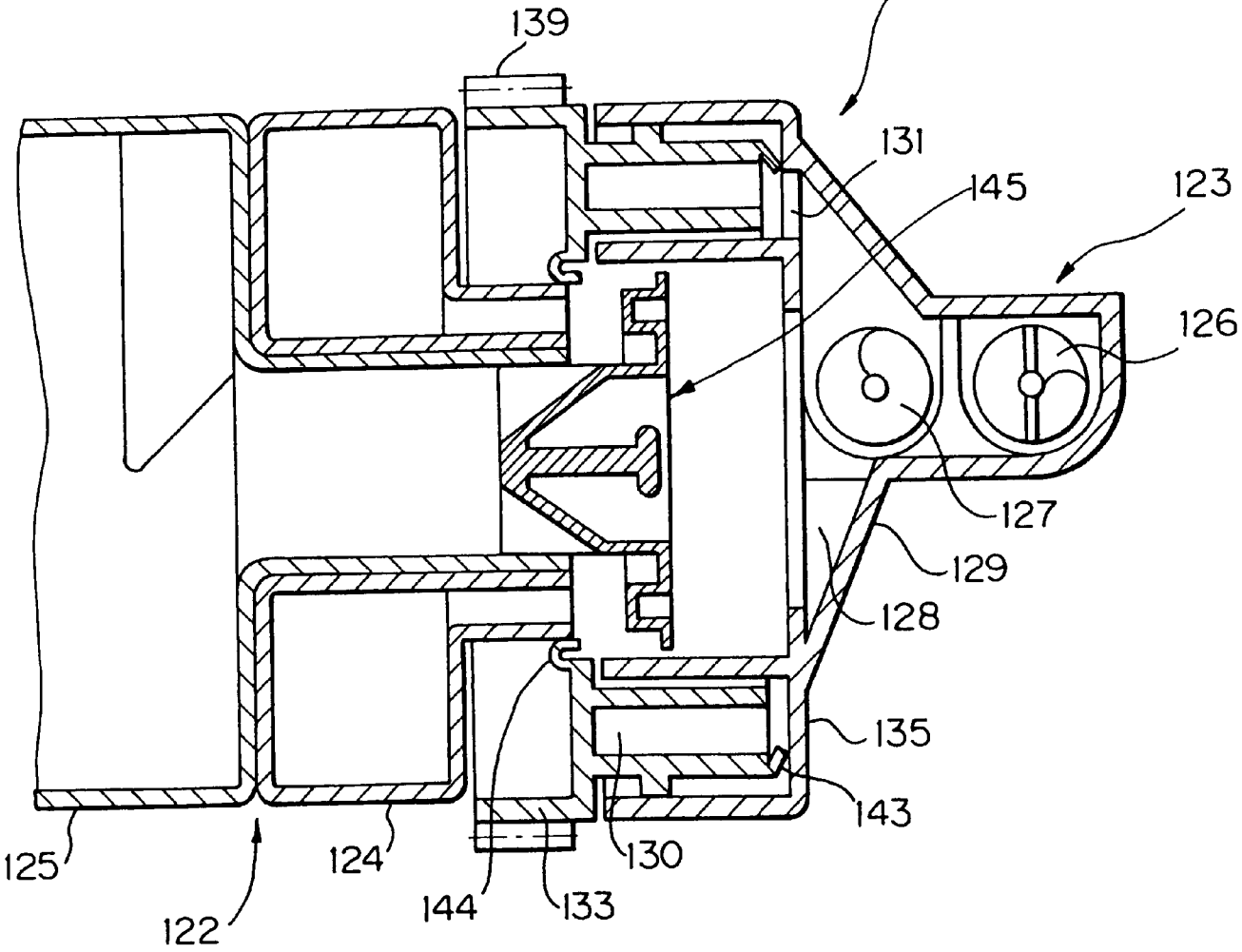
FIG. 25 are sections showing a conveying device, an intermediate connecting member and a rotary body included in the fourth embodiment.

As shown in FIG. 25, the developer from the above circulation system is at least partly dropped into a space 128 positioned below the second screw 127. This part of the developer is transferred from the space 128 to a rotatable space 130 via an opening formed in the lower portion of the side wall of a case 129 accommodating the screws 126 and 127. When the rotatable space 130 rotates, the developer is returned to the circulation system via an opening 131 formed in the upper portion of the above side wall of the case 129. If desired, the circulation system may be implemented only by the developing device 121, i.e., the conveyor mechanism 123 is not essential.

Figure 26A:
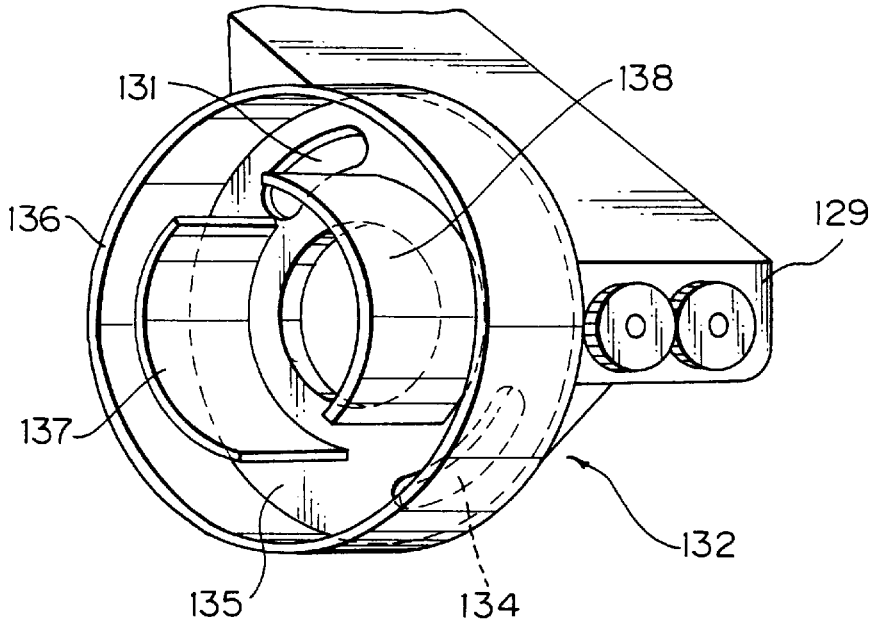
FIGS. 26A and 26B are perspective views showing the intermediate member and rotary body in detail.
Figure 26B:
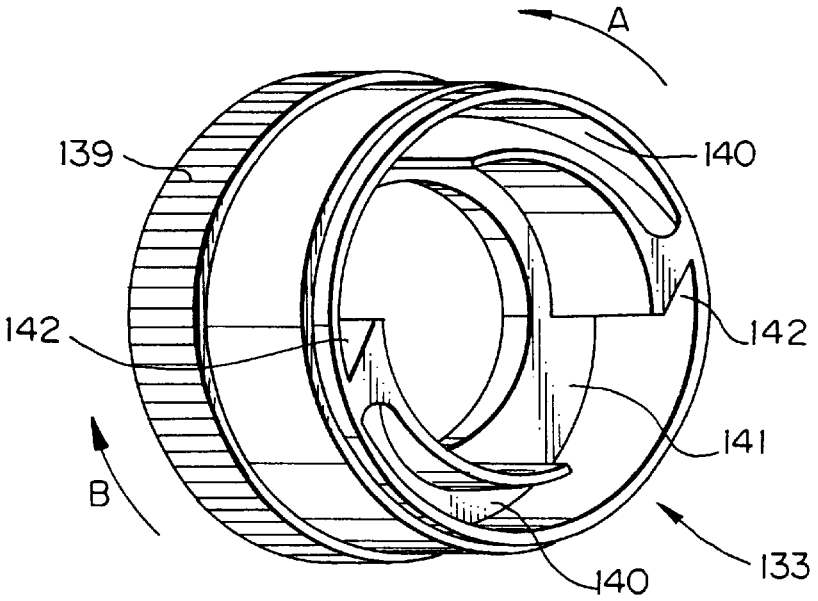

FIGS. 26A and 26B show an intermediate connecting member 132 and a rotary body 133 forming the above space 130. As shown, the connecting member 132 is molded integrally with the case 129 or fastened thereto by screws. The connecting member 132 delimits one end of the rotatable space 130 and has holes or supply ports 131 and 134, a flat portion 135 formed with a center opening, an annular flange 136 surrounding the flat portion 135, and blades 137 and 138. The holes 131 and 134 are respectively positioned in the second quadrant and the fourth quadrant, as seen from the rotary body 133 side. The blades 137 and 138 protrude away from the casing 129 while surrounding the opening of the flat portion 135. The blades 137 and 138 are spaced from each other by an upper and a lower clearance, as illustrated. The supply ports 131 and 134 are not aligned in the vertical direction, but located in the second and fourth quadrants, respectively. The allows the screw end to be located at a position desirable in the space efficiency aspect.

The rotary body 133 to mate with the connecting member 132 has a shallow cup-like configuration including a relatively great center opening. A gear 139 is affixed to the outer circumference of the rotary body 133. The rotation of a drive section, not shown, is transmitted to the gear 139. To return the developer to the circulation system, the body 133 is rotated in, e.g., the direction A. The body 133 has thereinside portions 140 for delivering the toner and developer to the conveyor mechanism 123, and portions 141 for returning the collected developer to the container 122. Specifically, at least one portion 140 and at least one portion 141 are provided in a pair (two pairs in the embodiment). The number of pairs is determined by the developer replenishing timing, developer collecting timing, and the volume of the developer. Alternatively, the number of the portions 140 and that of the portions 141 may be different, e.g., two portions 140 and one portion 141 may be provided. The replenishing ability will increase if the portions 140 is greater in number than the portions 141 while the collecting ability will increased if the latter is greater in number than the former. Each portion 140 is delimited by the circumferential wall of the body 33 and an inner wall which will slidably contact the outer periphery of the blade 137. The bottom of the portion 130 intervening between the two walls is higher at the upstream side with respect to the direction of rotation for developer replenishment than at the downstream side, forming an inclined surface. The portions 141 are flat surfaces flush with the downstream ends of the portions 140, and each includes a scoop portion 142 formed by the extension of the inner wall of the associated portion 140. During the rotation for developer replenishment (direction B), the portions 141 convey the collected developer.

When the intermediate connecting member 132 and rotary body 133 are put together, the rotatable space 130 is defined by the flat portion 135 of the member 132, the bottoms of the portions 140 and 141 of the rotary body 133, the circumferential wall and inner walls of the body 133, and the blades 137 and 138 of the member 132. A first seal member 143, FIG. 25, is fitted between the connecting member 132 and the rotary body 133 in order to block the developer during the rotation of the body 133. The seal member 143 may be implemented as a rubber-based V ring or a G seal or a substituted thereof, e.g., sponge. A second seal 144, FIG. 25, is fitted on the inner edge of the body 133 in order to retain and seal the container 122 when the container is mounted to the replenishing device.

Figure 27A:
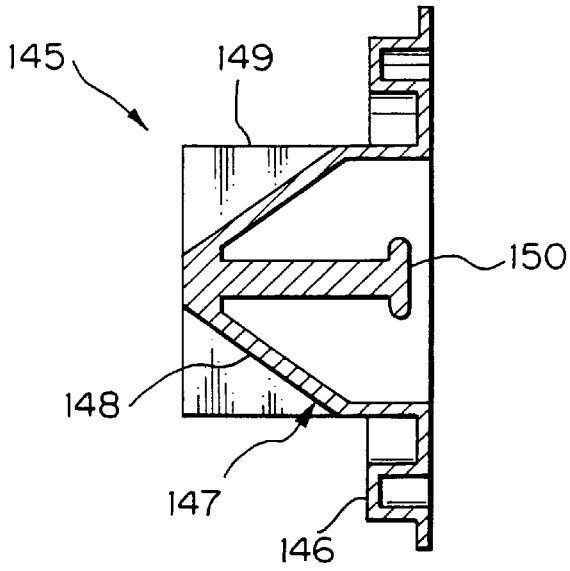
FIGS. 27A and 27B show a stopper included in the fourth embodiment.
Figure 27B:
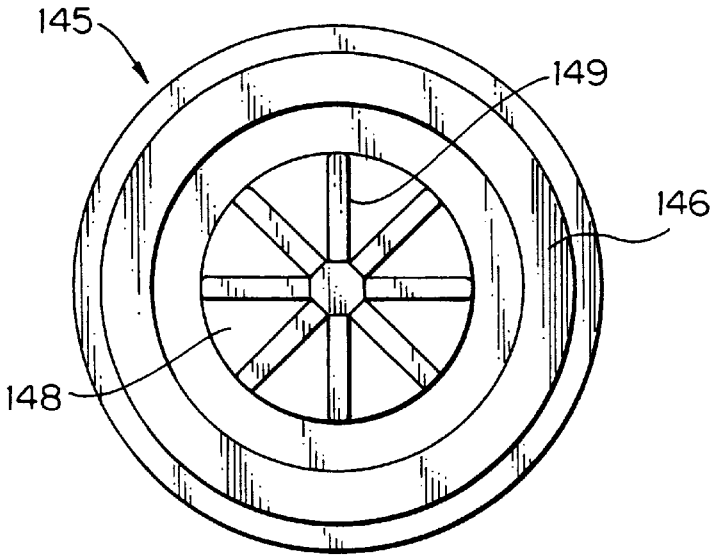

Referring again to FIG. 25, a stopper 145 for the container 122 is disposed in the space between the blades 137 and 138 of the connecting member 132. Initially, the stopper 145 closes the open end of the container 124 and that of the container 125 in order to prevent the developer and toner from leaking. In the event of replenishment and collection, the stopper 145 is pulled out by a predetermined amount by a chuck, not shown. As shown in FIGS. 27A and 27B in detail, the stopper 145 has a peripheral stop portion 146 for closing the container 124, and a central stop portion 147 for closing the container 125. The central stop portion 147 has a conical surface 148 protruding toward the container, and a plurality of (eight in the embodiment) blades 149 uniformly distributed on the conical surface 148. The conical surface 148 has an angle greater than the angle of repose of the developer, e.g., at least 20 degrees. In this condition, the developer dropped is automatically collected in the container due to gravity. The conical surface 148 and blades 149 function effectively in the event of collection of the developer. Specifically, the blades 149 surely catch the dropping developer while the conical surface 148 allows it to slide thereon into the container 125. To push and pull the stopper 145, the chuck chucks a nip portion 150 extending out from the stopper 145.

In operation, assume that the container 122 has run out of toner when the toner concentration of the developer in the developing device 121 is short and needs replenishment. Then, the user is urged to replace the container 122. After the user has mounted a new container 122 to the apparatus body, the chuck pulls out the stopper 145, as stated earlier. Then, the drive section, not shown, rotates the rotary body 133 in the direction A via the gear 139. At the same time, the container 122 is driven in the direction A by the drive section, not shown, with the result that fresh toner is discharged from the container 125. It is to be noted that the spiral ridge of the container 125 may be so configured as to discharge the toner when the container 122 is rotated in the direction B. As for the developer, the container 122 is rotated in the direction opposite to the direction for toner replenishment, so that the spiral ridge of the container 124 discharges the developer from the container 124 into the rotatable space 130. Specifically, the spiral ridge of the container 124 and that of the container 125 are inclinded in opposite directions to each other. As a result, when the container 122 is rotated in one direction, one of the powder stored in the container 124 and the powder stored in the container 125 is driven toward the outlet of the container while the other is driven deeper into the container.

The toner or the developer driven out of the container is dropped into the space 130 being rotated in the direction A. The toner or the developer is moved upward in the portions 140 due to the rotation of the space 130 and toward the replenishing device 123 due to the inclination of the portions 140. Consequently, the toner or the developer is driven out to the screw 127, which is in rotation, via the hole 131 of the connecting member 132. The toner or the developer is retained in the spaces defined by the inclined bottoms of the portions 140, circumferential wall and inner walls during conveyance. In this sense, the blade 137 sliding on the inner walls is omissible. The screws 126 and 127 start rotating at least at the same time as the container 122 and circulate the developer from the developing unit 121. Particularly, when fresh toner is replenished, the screws 126 and 127 allow it to begin to be mixed with the developer before reaching the developing unit 121. This minimizes irregularity in the toner concentration of the developer in the developing unit 121.

After a preselected amount of toner or developer has been replenished, the container 122 stops rotating, and the chuck closes the stopper 145. At this instant, the rotary body 133 and screws 126 and 127 are caused to stop rotating or continuously driven, as the case may be. When the screws 126 and 127 constitute a part of the developing unit 121, the body 133 and screws 126 and 127 should preferably be continuously driven in order to promote the agitation of the developer in the developing unit 121.

When the entire toner is discharged from the container 125, the container 125 turns out a container for collecting the deteriorated developer. In this case, the screws 126 and 127 are driven in the same manner as during the replenishment of the developer or that of the toner. The rotary body 133 is rotated in the direction B opposite to the direction A. The stopper 145 is opened to the position shown in FIG. 25. It is rational to effect the collection of the used developer at the time when toner replenishment is needed, as determined by the magnetic or optical toner concentration sensor included in the developing device 121 or a sensor responsive to the toner density on the photoconductive drum. A developer collection mode is set up when the container 125 has run out of toner.

The used developer flown out of the developing unit 121 is routed through the space 128 below the screw 127 and the hole 134 of the case 129 or connecting member 132 to the rotatable space 130. The developer entered the space 130 is retained in the space delimited by the circumferential wall of the body 133 and the blade 138, raised by the scoop portion 142 of the portion 141, dropped at the end of the blade 138, caught by the blades 149 of the stopper 145, and then collected in the container 125 along the conical surface 148. In this case, the container 125 is rotated in the direction opposite to the direction for toner replenishment, so that its spiral ridge drives the developer deeper into the container 125. When the used toner is collected in the container 125 in the same amount as the developer fed into the developing device 121, the collection ends. Then, the user is urged to replace the container. The used developer existing in the developing unit 121 may be replaced either entirely or only partly.

The above embodiment has a simple construction including a minimum number of parts and occupying a minimum of space. In addition, the embodiment is capable of surely replenishing toner and developer and collecting the used developer. Such a configuration prevents the apparatus body from being increased in size.

5th Embodiment

Figure 28:
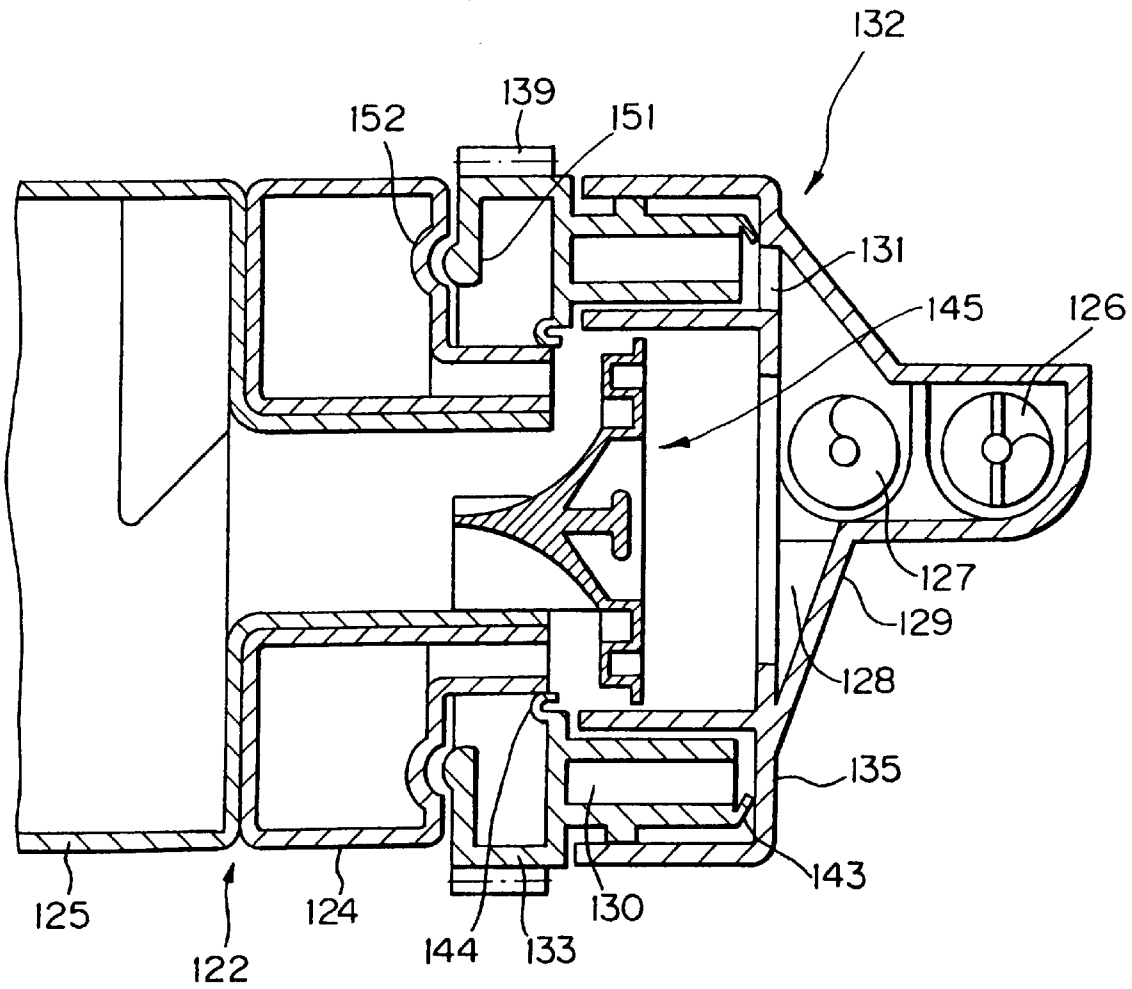
FIG. 28 is a section showing a fifth embodiment of the present invention.

This embodiment is essentially similar to the fourth embodiment except for the following. In the fourth embodiment, the bottle and rotary member are each rotated by the respective drive mechanism. By contrast, in this embodiment, they are driven by a single drive mechanism. Specifically, as shown in FIG. 28, the rotary body 133 includes a plurality of pawls, lugs, recesses or similar drive transmitting portions 151. The container 122 includes lugs, recesses or similar engaging portions 152 respectively corresponding to the drive transmitting portions 151. When the two portions 151 and 152 mate with each other, the rotation of the rotary body 133 is transmitted to the container 122 and causes it to rotate.

As stated above, the bottle and rotary body are driven by a single drive mechanism via their mating portions. This eliminates the need for a motor for driving the bottle, control members, transmission members, control driver, program sensor for control, and other members, while saving the space and cost. The reduced number of parts enhances reliable operation.

Various modifications will become possible for those skilled in the art after receiving the teachings of the present disclosure without departing from the scope thereof.

What is claimed is:

1. A method of replenishing toner, comprising the steps of:

(a) determining a toner concentration of a developer existing in a developing chamber;

(b) replenishing a part of the developer when step (a) determines the toner concentration of said developer equals a prescribed value; and (c) collecting the developer existing in said developing chamber based solely on a predetermined number of times step (b) consecutively replenishes the part of the developer.

2. A method as claimed in claim 1, further comprising the step of (d) reporting an end of toner after step (c) collects the developer.

3. A method of replenishing toner, comprising the steps of:

(a) determining a toner concentration of a developer existing in a developing chamber;

(b) replenishing a part of the developer when step (a) determines the toner concentration of said developer equals a prescribed value; and (c) collecting the developer existing in said developing chamber after a time when step (b) consecutively replenishes the part of the developer a predetermined number of times, wherein the collecting step (c) collects the developer into a container of a rotating bottle originally containing the developer, the bottle being rotated in a direction opposite to a direction in which the bottle was rotated to provide the developing chamber with the developer.

4. A method as claimed in claim 3, further comprising the step of (d) reporting an end of toner after step (c) collects the developer.

* * * * *